US008918315B2

(12) United States Patent
Oshikiri et al.

(10) Patent No.: US 8,918,315 B2
(45) **Date of Patent: *Dec. 23, 2014**

(54) ENCODING APPARATUS, DECODING APPARATUS, ENCODING METHOD AND DECODING METHOD

(71) Applicant: Panasonic Corporation, Osaka (JP)

(72) Inventors: Masahiro Oshikiri, Kanagawa (JP); Toshiyuki Morii, Kanagawa (JP); Tomofumi Yamanashi, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/965,644

(22) Filed: Aug. 13, 2013

(65) Prior Publication Data

US 2013/0325457 A1 Dec. 5, 2013

Related U.S. Application Data

(63) Continuation of application No. 12/528,659, filed as application No. PCT/JP2008/000408 on Feb. 29, 2008, now Pat. No. 8,554,549.

(30) Foreign Application Priority Data

| | | |
|---|---|---|
| Mar. 2, 2007 | (JP) | 2007-053502 |
| May 18, 2007 | (JP) | 2007-133545 |
| Jul. 13, 2007 | (JP) | 2007-185077 |
| Feb. 26, 2008 | (JP) | 2008-045259 |

(51) Int. Cl.
*G10L 19/00* (2013.01)

(Continued)

(52) U.S. Cl.
CPC ..... *G10L 19/00* (2013.01); *G10L 19/038* (2013.01); *G10L 19/24* (2013.01);

(Continued)

(58) Field of Classification Search
CPC ..... G10L 19/02; G10L 19/005; G10L 19/09; G10L 21/04; G10L 19/0212; G10L 19/10; G10L 19/06; G10L 25/06; G10L 19/032; G10L 19/18; G10L 19/12; G10L 19/167; G10L 21/0232; G10L 19/012; G10L 19/0017; G10L 25/78; G10L 15/02; G10L 19/24; G10L 19/038; G10L 9/0208; G10L 19/001; G10L 19/265; G10L 19/083; G10L 19/19
USPC ..... 704/205, 500–504, 219, 229, 206, 230, 704/200, 220, 200.1, 208, 223, 222, 232
See application file for complete search history.

(56) References Cited

U.S. PATENT DOCUMENTS 5,649,053 A 7/1997 Kim
5,826,224 A 10/1998 Gerson et al.

(Continued)

FOREIGN PATENT DOCUMENTS

CN 1650348 8/2005
CN 1735928 2/2006

(Continued)

OTHER PUBLICATIONS

Miki, "All about MPEG-4," the first edition, Kogyo Chosakai Publishing, Inc., Sep. 30, 1998, pp. 126-127, with partial English Translation.

(Continued)

*Primary Examiner* — Vijay B Chawan
(74) *Attorney, Agent, or Firm* — Greenblum & Bernstein P.L.C.

(57) ABSTRACT

An encoding apparatus includes a first layer encoder that encodes a signal, a first layer decoder that decodes first layer encoded data, a first layer error transform coefficient calculator that transforms a first layer error signal into a frequency domain and a second layer encoder that encodes the first layer error transform coefficient to acquire second layer encoded data. The second layer encoder includes a band determiner that determines a band to be encoded by the second layer encoder, and a first shape vector encoder that refers the first layer error transform coefficient included in the band to generate a first shape vector and first shape encoded information, a target gain calculator calculates target gain per subband, a gain vector generator generates a gain vector using a plurality of target gains, and a gain vector encoder encodes the gain vector to acquire gain encoded information.

5 Claims, 33 Drawing Sheets

(51) Int. Cl.

| | |
|---|---|
| ***G10L 19/038*** | (2013.01) |
| ***G10L 19/24*** | (2013.01) |
| ***G10L 19/02*** | (2013.01) |
| ***G10L 25/18*** | (2013.01) |
| ***G10L 19/005*** | (2013.01) |

(52) U.S. Cl.

CPC ..... *G10L 19/02* (2013.01); *G10L 25/18* (2013.01); *G10L 19/005* (2013.01)

USPC ..... 704/230; 704/205; 704/229; 704/220; 704/222; 704/200.1

(56) References Cited

U.S. PATENT DOCUMENTS

| | | | | |
|---|---|---|---|---|
| 6,108,626 | A * | 8/2000 | Cellario et al. | 704/230 |
| 6,192,334 | B1 | 2/2001 | Nomura | |
| 6,208,957 | B1 | 3/2001 | Nomura | |
| 6,353,808 | B1 | 3/2002 | Matsumoto et al. | |
| 6,438,525 | B1 | 8/2002 | Park | |
| 6,502,069 | B1 | 12/2002 | Grill et al. | |
| 6,611,798 | B2 | 8/2003 | Bruhn et al. | |
| 6,871,106 | B1 | 3/2005 | Ishikawa et al. | |
| 7,013,268 | B1 | 3/2006 | Gao et al. | |
| 7,013,269 | B1 * | 3/2006 | Bhaskar et al. | 704/219 |
| 7,299,174 | B2 | 11/2007 | Sato et al. | |
| 7,457,742 | B2 | 11/2008 | Kovesi et al. | |
| 7,562,021 | B2 * | 7/2009 | Mehrotra et al. | 704/500 |
| 7,653,539 | B2 | 1/2010 | Yamanashi et al. | |
| 7,729,905 | B2 | 6/2010 | Sato et al. | |
| 7,752,052 | B2 | 7/2010 | Oshikiri | |
| 7,769,584 | B2 * | 8/2010 | Oshikiri et al. | 704/230 |
| 7,835,904 | B2 | 11/2010 | Li et al. | |
| 7,978,771 | B2 | 7/2011 | Sato et al. | |
| 8,121,850 | B2 * | 2/2012 | Yamanashi et al. | 704/501 |
| 8,209,188 | B2 | 6/2012 | Oshikiri | |
| 8,306,827 | B2 * | 11/2012 | Yamanashi et al. | 704/500 |
| 8,352,258 | B2 * | 1/2013 | Yamanashi et al. | 704/230 |
| 8,554,549 | B2 * | 10/2013 | Oshikiri et al. | 704/223 |
| 2002/0010577 | A1 | 1/2002 | Matsumoto et al. | |
| 2002/0013703 | A1 | 1/2002 | Matsumoto et al. | |
| 2002/0107686 | A1 | 8/2002 | Unno | |
| 2003/0212251 | A1 | 11/2003 | Nakaie et al. | |
| 2005/0163323 | A1 | 7/2005 | Oshikiri | |
| 2005/0165611 | A1 | 7/2005 | Mehrotra et al. | |
| 2005/0252361 | A1 | 11/2005 | Oshikiri | |
| 2006/0036435 | A1 | 2/2006 | Kovesi et al. | |
| 2006/0173677 | A1 | 8/2006 | Sato et al. | |
| 2007/0016427 | A1 | 1/2007 | Thumpudi et al. | |
| 2007/0179780 | A1 | 8/2007 | Yamanashi et al. | |
| 2007/0225971 | A1 * | 9/2007 | Bessette | 704/203 |
| 2007/0271102 | A1 | 11/2007 | Morii | |
| 2008/0033717 | A1 | 2/2008 | Sato et al. | |
| 2008/0052066 | A1 * | 2/2008 | Oshikiri et al. | 704/221 |
| 2008/0126085 | A1 | 5/2008 | Morii | |
| 2008/0162148 | A1 | 7/2008 | Goto et al. | |
| 2009/0055172 | A1 | 2/2009 | Yoshida | |
| 2009/0070107 | A1 | 3/2009 | Kawashima et al. | |
| 2009/0076809 | A1 | 3/2009 | Yoshida | |
| 2009/0083041 | A1 | 3/2009 | Yoshida | |
| 2009/0094024 | A1 * | 4/2009 | Yamanashi et al. | 704/219 |
| 2009/0119111 | A1 | 5/2009 | Goto et al. | |
| 2010/0017199 | A1 * | 1/2010 | Oshikiri et al. | 704/205 |
| 2010/0169081 | A1 * | 7/2010 | Yamanashi et al. | 704/203 |
| 2010/0169084 | A1 * | 7/2010 | Zhang et al. | 704/207 |
| 2010/0217609 | A1 | 8/2010 | Oshikiri | |
| 2013/0325457 | A1 * | 12/2013 | Oshikiri et al. | 704/222 |

FOREIGN PATENT DOCUMENTS

| | | |
|---|---|---|
| EP | 0834863 | 4/1998 |
| EP | 1796084 | 6/2007 |
| JP | 7-261800 | 10/1995 |
| JP | 8-46517 | 2/1996 |
| JP | 10-282997 | 10/1998 |
| JP | 11-30997 | 2/1999 |
| JP | 2000-132193 | 5/2000 |
| JP | 2004-101720 | 4/2004 |
| JP | 2004-102186 | 4/2004 |
| JP | 2004-302259 | 10/2004 |
| JP | 2006-72026 | 3/2006 |
| JP | 2006-513457 | 4/2006 |
| JP | 2006-133423 | 5/2006 |
| WO | 2006/070760 | 7/2006 |
| WO | 2007/105586 | 9/2007 |

OTHER PUBLICATIONS

U.S. Appl. No. 12/529,212 to Oshikiri, filed Aug. 31, 2009.
U.S. Appl. No. 12/528,661 to Sato et al, filed Aug. 26, 2009.
U.S. Appl. No. 12/528,671 to Kawashima et al, filed Aug. 26, 2009.
U.S. Appl. No. 12/528,869 to Oshikiri et al, filed Aug. 27, 2009.
U.S. Appl. No. 12/528,877 to Morii et al, filed Aug. 27, 2009.
U.S. Appl. No. 12/529,219 to Morii et al, filed Aug. 31, 2009.
U.S. Appl. No. 12/528,871 to Morii et al, filed Aug. 27, 2009.
U.S. Appl. No. 12/528,878 to Ehara, filed Aug. 27, 2009.
U.S. Appl. No. 12/528,880 to Ehara, filed Aug. 27, 2009.
Oshikiri M et al., "A Scalable coder designed for 10-KHZ bandwidth speech", Speech Coding, 2002, IEEE Workshop Proceedings, Oct. 6-9, 2002, Piscataway, NJ, USA, IEEE, Oct. 6, 2002, XP010647230, pp. 111-113.
Oshikiri et al., "A 10 kHz bandwidth scalable codec using adaptive selection VQ of time-frequency coefficients", Forum on Information Technology, vol. F017, No. pp. 239-240, vol. 2, along with a partial English language Translation, Aug. 25, 2003.
Oshikiri et al., "Efficient Spectrum Coding for Super-Wideband Speech and its Application to 7/10/15KHZ Bandwidth Scalable Coders", Proc. IEEE Int. Conf. Acoustic Speech Signal Process, vol. 2004, No. vol. 1, pp. I-481-I.484, 2004.
Oshikiri et al., "A 7/10/15kHz bandwidth scalable coder using pitch filtering based spectrum coding", The Acoustical Society of Japan, Research Committee Meeting, lecture thesis collection, vol. 2004, pp. 327-328, Spring 1, along with a partial English language Translation, Mar. 17, 2004.
Oshikiri et al., "Improvement of the super-wideband scalable coder using pitch filtering based spectrum coding", The Acoustical Society of Japan, Research Committee Meeting, lecture thesis collection, vol. 2004, pp. 297-298, Autumn 1, along with a partial English language Translation, Sep. 21, 2004.
Oshikiri et al., "Study on a low-delay MDCT analysis window for a scalable speech coder", The Acoustical Society of Japan, Research Committee Meeting, lecture thesis collection, vol. 2005, pp. 203-204, Spring 1, along with a partial English language Translation, Mar. 8, 2005.
Oshikiri et al., "A 7/10/15 kHz Bandwidth Scalable Speeds Coder Using Pitch Filtering Based Spectrum Coding", IEICE D, vol. J89-D, No. 2, pp. 281-291, along with a partial English language Translation, Feb. 1, 2006.
Koishida et al., "A 16-kbit/s bandwidth scalable audio coder based on the G.729 standard", Proc. IEEE ICASSP 2000, pp. II-1149-II-1152, Jun. 2000.
Dietz et al., "Spectral band replication, a novel approach in audio coding", The 112th Audio Engineering Society Convention, Paper 5553, May 2002.
Oshikiri, "Research on variable bit rate high efficiency speech coding focused on speech spectrum", Doctoral thesis, Tokai University, along with a partial English language Translation, Mar. 24, 2006.
Jin et al., "Scalable Audio Coding Based on Hierarchical Transform Coding Modules", ICICE, vol. J83-A, No. 3, pp. 241-252, along with a partial English language Translation, Mar. 2000.
B. Grill, "A bit rate scalable perceptual coder for MPEG-4 audio", The 103rd Audio Engineering Society Convention, Preprint 4620 , Sep. 1997.
S. Ramprashad, "A two stage hybrid embedded speech/audio coding structure", Proc. IEEE ICASSP '98, pp. 337-340, May 1998.
Kovesi et al., "A scalable speech and audio coding scheme with continuous bitrate flexibility", Proc. IEEE ICASSP 2004, pp. I-273-I-276, May 2004.

(56) References Cited

OTHER PUBLICATIONS

Jung et al., "A bit-rate/bandwidth scalable speech coder based on ITU-T G.723.1 standard", Proc. IEEE ICASSP 2004, pp. I-285-I-288, May 2004.
Oshikiri et al., "A narrowband/wideband scalable speech coder using AMR coder as a core-layer", The Acoustical Society of Japan, Research Committee Meeting, lecture thesis collection(CD-ROM), vol. 2006, pp. 389-390, Q-28 Spring, along with a partial English language Translation, Mar. 7, 2006.
Oshikiri et al., "An 8-32 kbit/s scalable wideband coder extended with MDCT-based bandwidth extension on top of a 6.8 kbit/s narrowband CELP code", International Speech Communication Association, 8th Annual Conference of the International Speech Communication Association, Interspeech 2007., vol. 1, pp. 465-468, Aug. 27, 2007.
Kim et al., "A new bandwidth scalable wideband speech/audio coder", Proceedings of IEEE International Conference on Acoustics, Speech and Signal Processing 2002 (ICASSP-2002), pp. I-657-I-660, 2002.
Geiser et al., "A qualified ITU-T G.729EV codec candidate for hierachical speech and audio coding", Proceedings of IEEE 8th Workshop on Multimedia Signal Processing, pp. 114-118, Oct. 3, 2006.
Ragot et al., "A 8-32 kbit/s scalable wideband speech and audio coding candidate for ITU-T G729EV standardization", Proceedings of IEEE International Conference on Acoustics Speech and Signal Processing 2006 (ICASSP-2006), pp. I-1-I-4, May 14, 2006.
Massaloux et al., "An 8-12 kbit/s embedded CELP coder interoperable with ITU-T G.729 coder: first stage of the new G.729.1 standard", Proceedings of IEEE International Conference on Acoustics, Speech and Signal Processing 2007 (ICASSP-2007), pp. IV-1105-IV-1108, Apr. 15, 2007.
China Office action, mail date is Aug. 24, 2011.
Russia Office action, mail date is Feb. 7, 2012.
Japan Office action, mail date is Mar. 5, 2013.
Search report from E.P.O., mail date is Jul. 17, 2013.
XP017466254, "G.729-based embedded variable bit-rate coder: An 8-32 kbit/s scalable wideband coder bitstream interoperable with G. 729; G.729.1 (May 2006)", ITU-T Standard, International Telecommunication, Geneva; CH, No. G.729.1 May 29, 2006, pp. 1-100.
XP017543344, Masahiro Oshikiri Matsushita Electric (Panasonic) Japan: High level description of G.EV candidate codec algorithm proposed by Panasonic; AC-0703-Q9-09:, ITU-T Draft; Study Period 2005-2008, International Telecommunication Union, Geneva; CH, vol. 9/16, Mar. 5, 2007, pp. 1-9.

* cited by examiner

ENCODING APPARATUS, DECODING APPARATUS, ENCODING METHOD AND DECODING METHOD

CROSS-REFERENCE TO RELATED APPLICATIONS

The present application is a continuation of pending U.S. application Ser. No. 12/528,659, filed on Aug. 26, 2009, which is a National Stage of International Patent Application No. PCT/JP2008/000408, filed Feb. 29, 2008, which claims priority to Japanese Application Nos. JP 2008-045259, filed on Feb. 26, 2008, JP 2007-053502, filed on Mar. 2, 2007, JP 2007-133545, filed on May 18, 2007, and JP 2007-185077, filed on Jul. 13, 2007, the disclosures of which are expressly incorporated by reference herein in their entireties.

TECHNICAL FIELD

The present invention relates to an encoding apparatus and encoding method used in a communication system that encodes and transmits input signals such as speech signals.

BACKGROUND ART

It is demanded in a mobile communication system that speech signals are compressed to low bit rates to transmit to efficiently utilize radio wave resources and so on. On the other hand, it is also demanded that quality improvement in phone call speech and call service of high fidelity be realized, and, to meet these demands, it is preferable to not only provide quality speech signals but also encode other quality signals than the speech signals, such as quality audio signals of wider bands.

The technique of integrating a plurality of coding techniques in layers is promising for these two contradictory demands. This technique combines in layers the base layer for encoding input signals in a form adequate for speech signals at low bit rates and an enhancement layer for encoding differential signals between input signals and decoded signals of the base layer in a form adequate to other signals than speech. The technique of performing layered coding in this way have characteristics of providing scalability in bit streams acquired from an encoding apparatus, that is, acquiring decoded signals from part of information of bit streams, and, therefore, is generally referred to as "scalable coding (layered coding)."

The scalable coding scheme can flexibly support communication between networks of varying bit rates thanks to its characteristics, and, consequently, is adequate for a future network environment where various networks will be integrated by the IP (Internet Protocol).

For example, Non-Patent Document 1 discloses a technique of realizing scalable coding using the technique that is standardized by MPEG-4 (Moving Picture Experts Group phase-4). This technique uses CELP (Code Excited Linear Prediction) coding adequate to speech signals, in the base layer, and uses transform coding such as AAC (Advanced Audio Coder) and TwinVQ (Transform Domain Weighted Interleave Vector Quantization) with respect to residual signals subtracting base layer decoded signal from original signal, in the enhancement layer.

Further, to flexibly support a network environment in which transmission speed dynamically fluctuates due to handover between different types of networks and the occurrence of congestion, scalable encoding of small bit rate scales needs to be realized and, accordingly, needs to be configured by providing multiple layers of lower bit rates.

Patent Document 1 and Patent Document 2 disclose a technique of transform encoding of transforming a signal which is the target to be encoded, in the frequency domain and encoding the resulting frequency domain signal. In such transform encoding, first, an energy component of a frequency domain signal, that is, gain (i.e. scale factor) is calculated and quantized on a per subband basis, and a fine component of the above frequency domain signal, that is, shape vector, is calculated and quantized.

Non-Patent Document 1: "All about MPEG-4," written and edited by Sukeichi MIKI, the first edition, Kogyo Chosakai Publishing, Inc., Sep. 30, 1998, page 126 to 127

Patent Document 1: Japanese Translation of PCT Application Laid-Open No.2006-513457

Patent Document 2: Japanese Patent Application Laid-Open No.HEI7-261800

DISCLOSURE OF THE INVENTION

Problems to be Solved by the Invention

However, when two successive parameters are quantized in order, the parameter that is quantized later is influenced by the quantization distortion of the parameter that is quantized earlier, and therefore is inclined to show increased quantization distortion. Therefore, there is a general tendency that, in transform encoding disclosed in Patent Document 1 and Patent Document 2 for quantizing a gain and shape vector in order, shape vectors show increased quantization distortion and are unable to represent the accurate spectral shape. This problem produces significant quality deterioration with respect to signals of strong tonality such as vowels, that is, signals having spectral characteristics that multiple peak shapes are observed. This problem becomes more distinct when a lower bit rate is implemented.

It is therefore an object of the present invention to provide an encoding apparatus and encoding method for accurately encoding the spectral shapes of signals of strong tonality such as vowels, that is, the spectral shapes of signals having spectral characteristics that multiple peak shapes are observed, and improving the quality of decoded signals such as the sound quality of decoded signals.

Means for Solving the Problem

The encoding apparatus according to the present invention employs a configuration which includes: a base layer encoding section that encodes an input signal to acquire base layer encoded data; a base layer decoding section that decodes the base layer encoded data to acquire a base layer decoded signal; and an enhancement layer encoding section that encodes a residual signal representing a difference between the input signal and the base layer decoded signal, to acquire enhancement layer encoded data, and in which the enhancement layer encoding section has: a dividing section that divides the residual signal into a plurality of subbands; a first shape vector encoding section that encodes the plurality of subbands to acquire first shape encoded information, and that calculates target gains of the plurality of subbands; a gain vector forming section that forms one gain vector using the plurality of target gains; and a gain vector encoding section that encodes the gain vector to acquire first gain encoded information.

The encoding method according to the present invention includes: dividing transform coefficients acquired by transforming an input signal in a frequency domain, into a plurality of subbands; encoding transform coefficients of the plurality of subbands to acquire first shape encoded information and calculating target gains of the transform coefficients of the plurality of subbands; forming one gain vector using the plurality of target gains; and encoding the gain vector to acquire first gain encoded information.

Advantageous Effects of Invention

The present invention can more accurately encode the spectral shapes of signals of strong tonality such as vowels, that is, the spectral shapes of signals having spectral characteristics that multiple peak shapes are observed, and improve the quality of decoded signals such as the sound quality of decoded signals.

BEST MODE FOR CARRYING OUT THE INVENTION

Hereinafter, embodiments of the present invention will be explained in detail with reference to the accompanying drawings. A speech encoding apparatus/speech decoding apparatus will be used as an example of an encoding apparatus/decoding apparatus according to the present invention to explain below.

(Embodiment 1)

Figure 1:
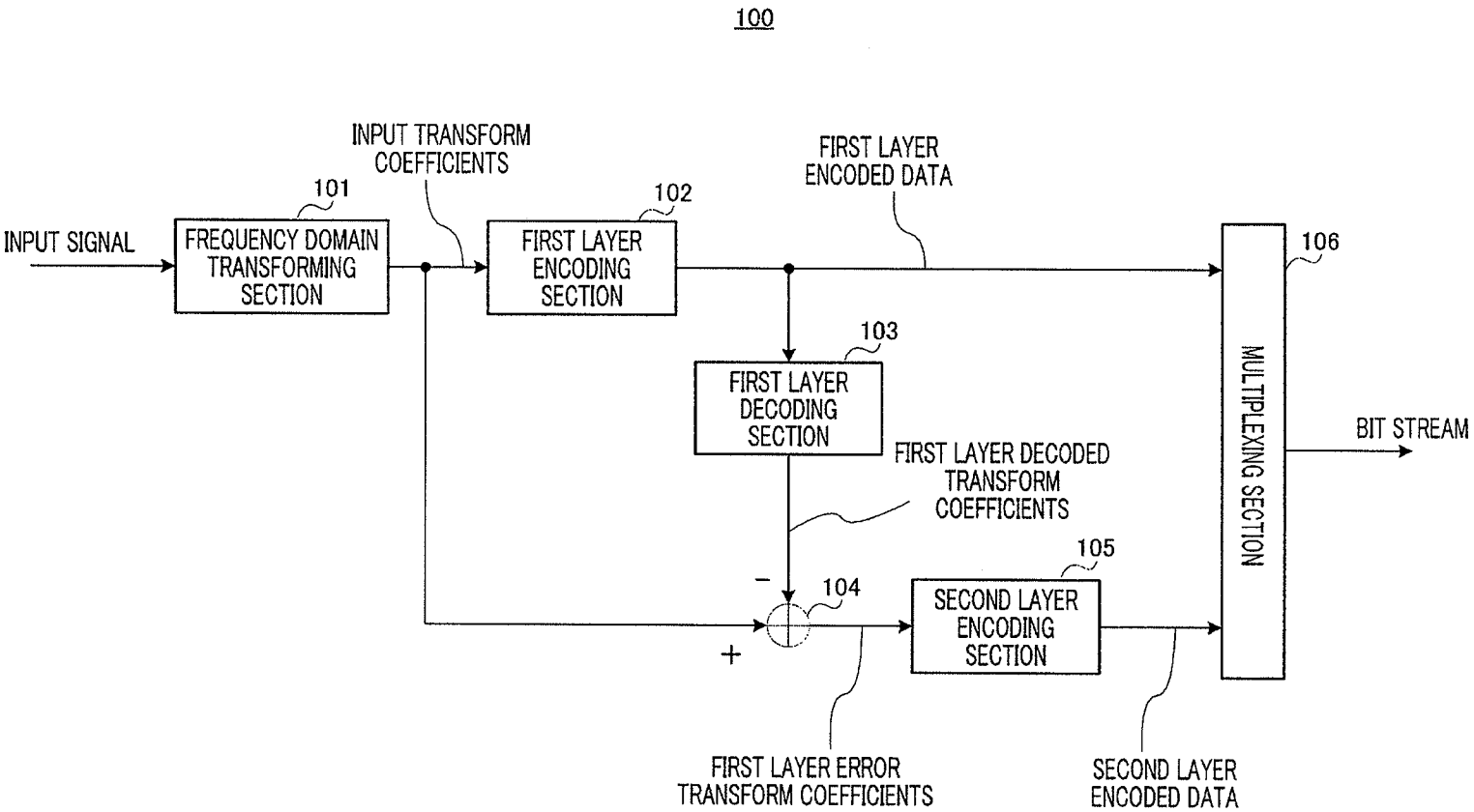
FIG. 1 is a block diagram showing the main configuration of a speech encoding apparatus according to Embodiment 1 of the present invention.

FIG. 1 is a block diagram showing the main configuration of speech encoding apparatus 100 according to Embodiment 1 of the present invention. An example will be explained where the speech encoding apparatus and speech decoding apparatus according to the present embodiment employ a scalable configuration of two layers. Further, the first layer constitutes the base layer and the second layer constitutes the enhancement layer.

In FIG. 1, speech encoding apparatus 100 has frequency domain transforming section 101, first layer encoding section 102, first layer decoding section 103, subtractor 104, second layer encoding section 105 and multiplexing section 106.

Frequency domain transforming section 101 transforms a time domain input signal into a frequency domain signal, and outputs the resulting input transform coefficients to first layer encoding section 102 and subtractor 104.

First layer encoding section 102 performs encoding processing with respect to the input transform coefficients received from frequency domain transforming section 101, and outputs the resulting first layer encoded data to first layer decoding section 103 and multiplexing section 106.

First layer decoding section 103 performs decoding processing using the first layer encoded data received from first layer encoding section 102, and outputs the resulting first layer decoded transform coefficients to subtractor 104.

Subtractor 104 subtracts the first layer decoded transform coefficients received from first layer decoding section 103, from the input transform coefficients received from frequency domain transforming section 101, and outputs the resulting first layer error transform coefficients to second layer encoding section 105.

Second layer encoding section 105 performs encoding processing with respect to the first layer error transform coefficients received from subtractor 104, and outputs the resulting second layer encoded data to multiplexing section 106. Further, second layer encoding section 105 will be described in detail later.

Multiplexing section 106 multiplexes the first layer encoded data received from first layer encoding section 102 and the second layer encoded data received from second layer encoding section 105, and outputs the resulting bit stream to a transmission channel.

Figure 2:
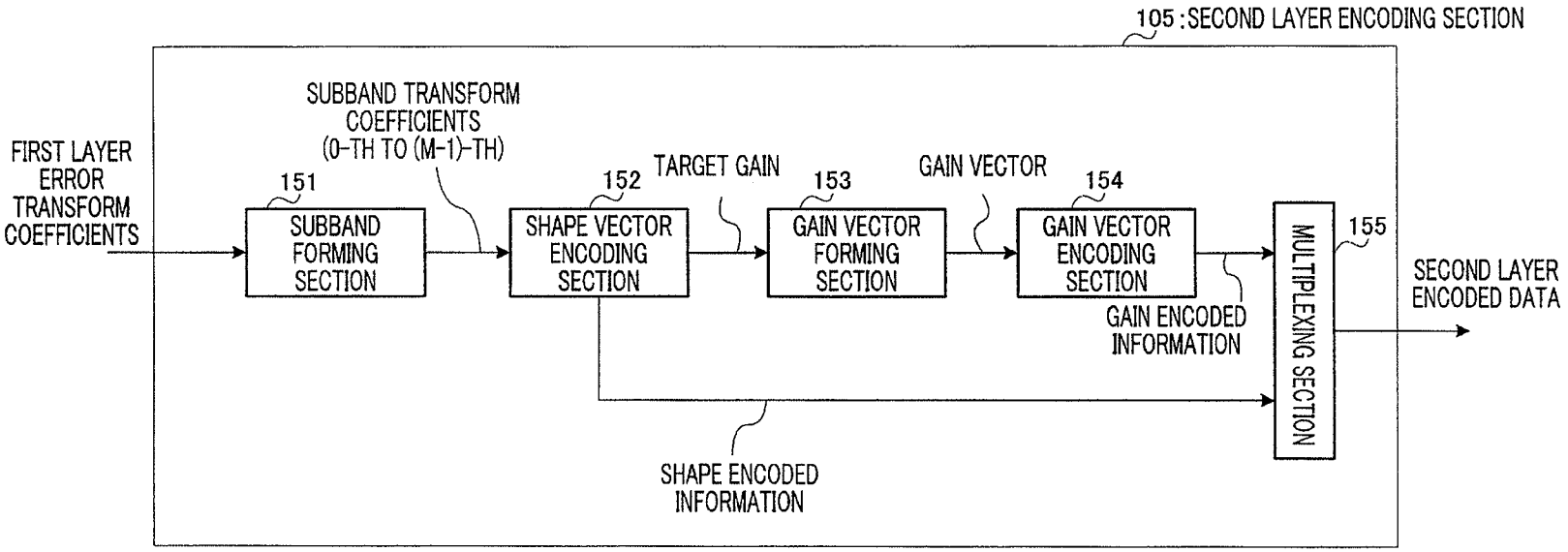
FIG. 2 is a block diagram showing the configuration inside a second layer encoding section according to Embodiment 1 of the present invention.

FIG. 2 is a block diagram showing the configuration inside second layer encoding section 105.

In FIG. 2, second layer encoding section 105 has subband forming section 151, shape vector encoding section 152, gain vector forming section 153, gain vector encoding section 154 and multiplexing section 155.

Subband forming section 151 divides the first layer error transform coefficients received from subtractor 104, into M subbands, and outputs the resulting M subband transform coefficients to shape vector encoding section 152. Here, when the first layer error transform coefficients are represented as $e_1(k)$, the m-th subband transform coefficients e(m,k) (where $0 \le m \le M-1$) are represented by following equation 1.

[1]

$$e(m,k)=e_1(k+F(m))(0 \le k < F(m+1)-F(m)) \quad \text{(Equation 1)}$$

In equation 1, F(m) represents the frequency in the boundary in each subband, and the relationship of $0 \le F(0) < F(1) < \ldots < F(M) \le FH$ holds. Here, FH represents the highest frequency of the first layer error transform coefficients, and m assumes an integer of $0 \le m \le M-1$.

Shape vector encoding section 152 performs shape vector quantization with respect to the M subband transform coefficients sequentially received from subband forming section 151, to generate shape encoded information of the M subbands and calculates target gains of the M subband transform coefficients. Shape vector encoding section 152 outputs the generated shape encoded information to multiplexing section 155, and outputs the target gains to gain vector forming section 153. Further, shape vector encoding section 152 will be described in detail later.

Gain vector forming section 153 forms one gain vector with the M target gains received from shape vector encoding section 152, and outputs this gain vector to gain vector encoding section 154. Further, gain vector forming section 153 will be described in detail later.

Gain vector encoding section 154 performs vector quantization using the gain vector received from gain vector forming section 153 as a target value, and outputs the resulting gain encoded information to multiplexing section 155. Further, gain vector encoding section 154 will be described in detail later.

Multiplexing section 155 multiplexes the shape encoded information received from shape vector encoding section 152 and gain encoded information received from gain vector encoding section 154, and outputs the resulting bit stream as second layer encoded data to multiplexing section 106.

Figure 3:
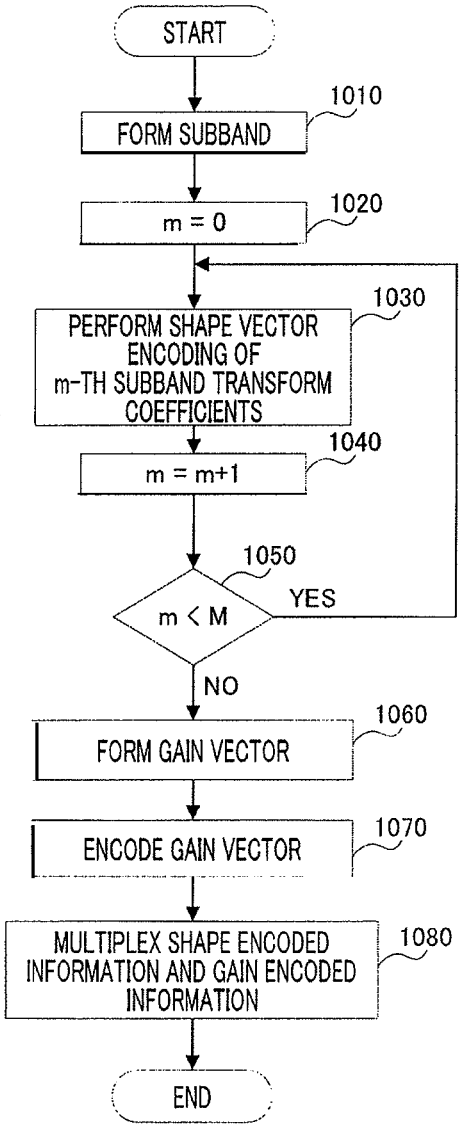
FIG. 3 is a flowchart showing steps of second layer encoding processing in the second layer encoding section according to Embodiment 1 of the present invention.

FIG. 3 shows a flowchart showing steps of second layer encoding processing in second layer encoding section 105.

First, in step (hereinafter, abbreviated as "ST") 1010, subband forming section 151 divides the first layer error transform coefficients into M subbands to form M subband transform coefficients.

Next, in ST 1020, second layer encoding section 105 initializes a subband counter m that counts subbands, to "0."

Next, in ST 1030, shape vector encoding section 152 performs shape vector encoding with respect to the m-th subband transform coefficients to generate the m-th subband shape encoded information and generate the m-th subband transform coefficients target gain.

Next, in ST 1040, second layer encoding section 105 increments the subband counter m by one.

Next, in ST 1050, second layer encoding section 105 decides whether or not m<M holds.

In ST 1050, when deciding that m<M holds (ST 1050: "YES"), second layer encoding section 105 returns the processing step to ST 1030.

By contrast with this, in ST 1050, when deciding that m<M does not hold (ST1050: "NO"), gain vector forming section 153 forms one gain vector using M target gains in ST 1060.

Next, in ST 1070, gain vector encoding section 154 performs vector quantization using the gain vector formed in gain vector forming section 153 as a target value to generate gain encoded information.

Next, in ST 1080, multiplexing section 155 multiplexes shape encoded information generated in shape vector encoding section 152 and gain encoded information generated in gain vector encoding section 154.

Figure 4:
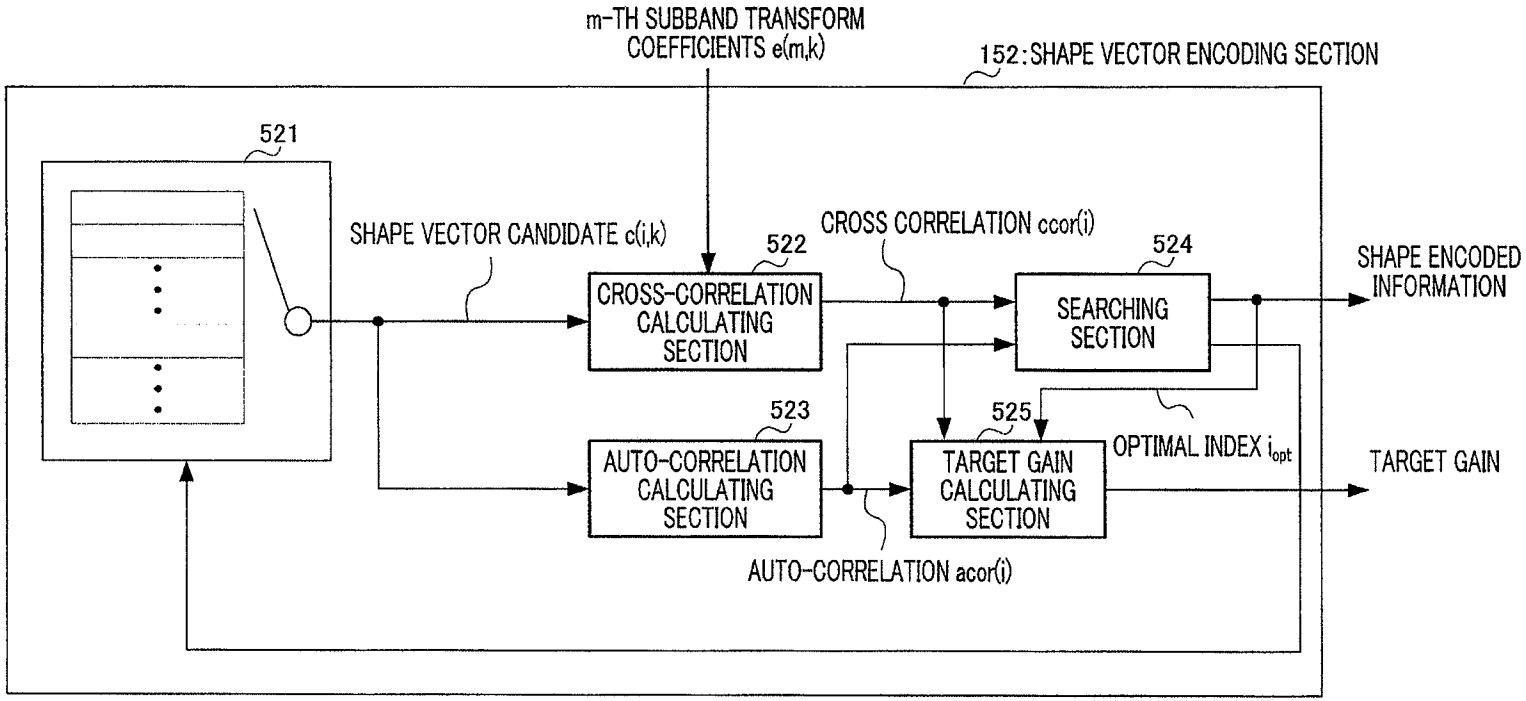
FIG. 4 is a block diagram showing the configuration inside a shape vector encoding section according to Embodiment 1 of the present invention.

FIG. 4 is a block diagram showing the configuration inside shape vector encoding section 152.

In FIG. 4, shape vector encoding section 152 has shape vector codebook 521, cross-correlation calculating section 522, auto-correlation calculating section 523, searching section 524 and target gain calculating section 525.

Shape vector codebook 521 stores a plural of shape vector candidates representing the shape of the first layer error transform coefficients, and outputs shape vector candidates sequentially to cross-correlation calculating section 522 and auto-correlation calculating section 523 based on a control signal received from searching section 524. Further, generally, there are cases where a shape vector codebook adopts mode of actually securing storing space and storing shape vector candidates, and there are cases where a shape vector codebook forms shape vector candidates according to predetermined processing steps. In later cases, it is not necessary to actually secure storing space. Although any one of the shape vector codebooks may be used in the present embodiment, the present embodiment will be explained below assuming that shape vector codebook 521 storing shape vector candidates shown in FIG. 4 is provided. Hereinafter, the i-th shape vector candidate in the plural of shape vector candidates stored in shape vector codebook 521, is represented as c(i,k). Here, k represents the k-th element of a plurality of elements forming a shape vector candidate.

Cross-correlation calculating section 522 calculates the cross correlation ccor(i) between the m-th subband transform coefficients received from subband forming section 151 and the i-th shape vector candidate received from shape vector codebook 521, according to following equation 2, and outputs the cross correlation ccor(i) to searching section 524 and target gain calculating section 525.

(Equation 2)

$$ccor(i) = \sum_{k=0}^{F(m+1)-F(m)-1} e(m, k) \cdot c(i, k) \quad [2]$$

Auto-correlation calculating section 523 calculates the auto-correlation acor(i) of the shape vector candidate c(i,k) received from shape vector codebook 521, according to following equation 3, and outputs the auto-correlation acor(i) to searching section 524 and target gain calculating section 525.

(Equation 3)

$$acor(i) = \sum_{k=0}^{F(m+1)-F(m)-1} c(i, k)^2 \quad [3]$$

Searching section 524 calculates a contribution A represented by following equation 4 using the cross-correlation ccor(i) received from cross-correlation calculating section 522 and the auto-correlation acor(i) received from auto-correlation calculating section 523, and outputs a control signal to shape vector codebook 521 until the maximum value of the contribution A is found. Searching section 524 outputs the index $i_{opt}$ of the shape vector candidate of when the contribution A maximizes, as an optimal index, to target gain calculating section 525, and outputs the index $i_{opt}$ as shape encoded information to multiplexing section 155.

(Equation 4)

$$A = \frac{ccor(i)^2}{acor(i)} \quad [4]$$

Target gain calculating section 525 calculates the target gain according to following equation 5 using the cross-correlation ccor(i) received from cross-correlation calculating section 522, the auto-correlation acor(i) received from auto-correlation calculating section 523 and the optimal index $i_{opt}$ received from searching section 524, and outputs this target gain to gain vector forming section 153.

(Equation 5)

$$\text{gain} = \frac{ccor(i_{opt})}{acor(i_{opt})} \quad [5]$$

Figure 5:
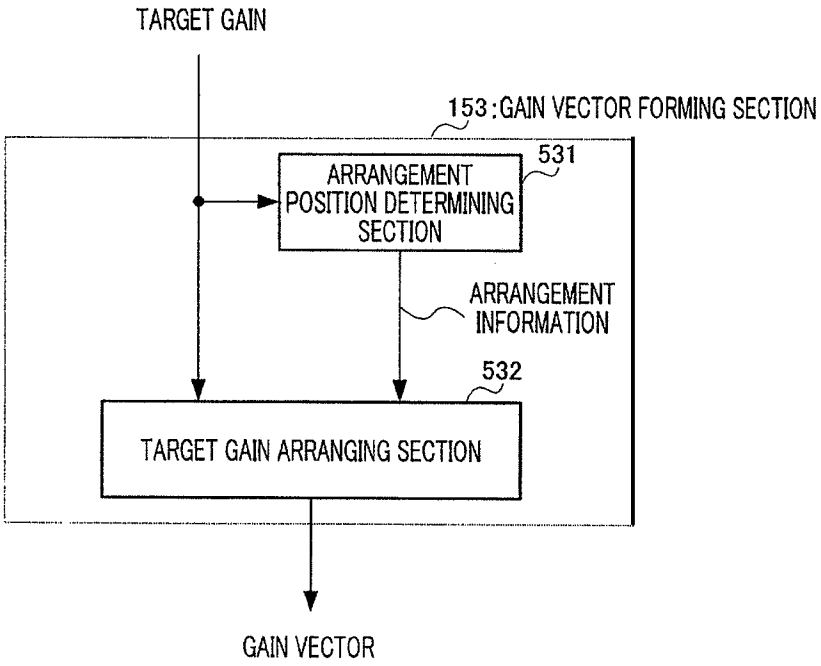
FIG. 5 is a block diagram showing the configuration inside the gain vector forming section according to Embodiment 1 of the present invention.

FIG. 5 is a block diagram showing the configuration inside gain vector forming section 153.

In FIG. 5, gain vector forming section 153 has arrangement position determining section 531 and target gain arranging section 532.

Arrangement position determining section 531 has a counter that assumes "0" as an initial value, increments the value on the counter by one each time a target gain is received from shape vector encoding section 152 and, when the value on the counter reaches the total number of subbands M, sets the value on the counter to zero again. Here, M is also the vector length of a gain vector formed in gain vector forming section 153, and processing in the counter provided in arrangement position determining section 531 equals dividing the value on the counter by the vector length of the gain vector and finding its remainder. That is, the value on the counter assumes an integer between "0" and "M−1." Each time the value on the counter is updated, arrangement position determining section 531 outputs the updated value on the counter as arrangement information to target gain arranging section 532.

Target gain arranging section 532 has M buffers that assume "0" as an initial value and a switch that arranges the target gain received from shape vector encoding section 152, in each buffer, and this switch arranges the target gain received from shape vector encoding section 152, in a buffer that is assigned as a number the value shown by arrangement information received from arrangement position determining section 531.

Figure 6:
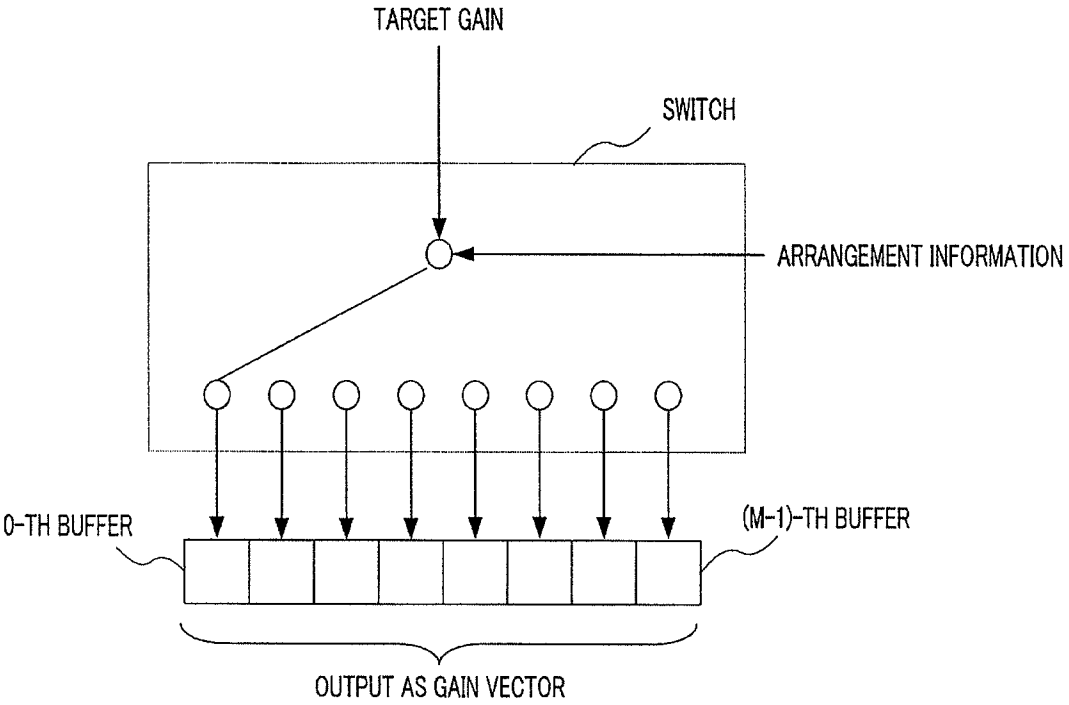
FIG. 6 illustrates in detail the operation of a target gain arranging section according to Embodiment 1 of the present invention.

FIG. 6 illustrates the operation of target gain arranging section 532 in detail.

In FIG. 6, when arrangement information inputted in the switch shows "0," the target gain is arranged in the 0-th buffer and, when arrangement information shows "M−1," the target gain is arranged in the (M−1)-th buffer. When target gains are arranged in all buffers, target gain arranging section 532 outputs a gain vector formed with the target gains arranged in M buffers, to gain vector encoding section 154.

Figure 7:
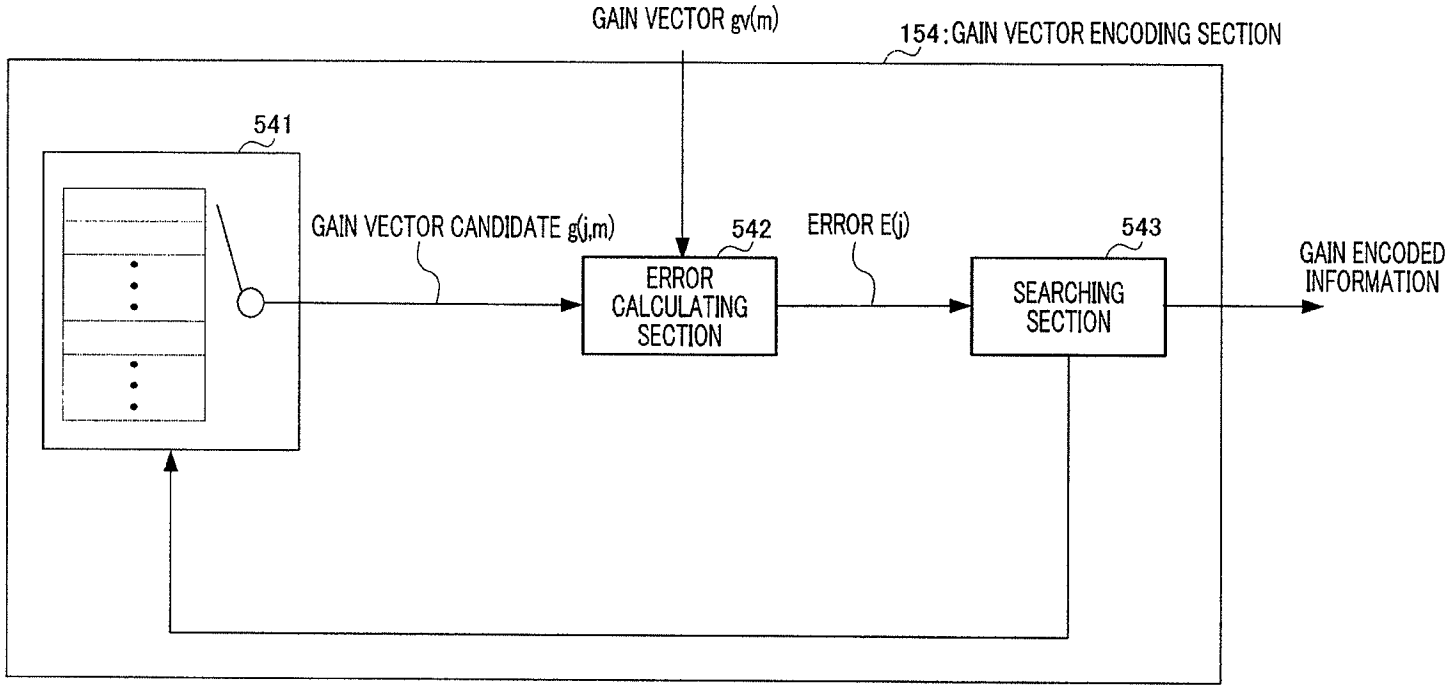
FIG. 7 is a block diagram showing the configuration inside a gain vector encoding section according to Embodiment 1 of the present invention.

FIG. 7 is a block diagram showing the configuration inside gain vector encoding section 154.

In FIG. 7, gain vector encoding section 154 has gain vector codebook 541, error calculating section 542 and searching section 543.

Gain vector codebook 541 stores a plural of gain vector candidates representing a gain vector, and outputs the gain vector candidates sequentially to error calculating section 542, based on the control signal received from searching section 543. Further, generally, there are cases where a gain vector codebook adopts mode of actually securing storing space and storing gain vector candidates, and there are cases where a gain vector codebook forms gain vector candidates according to predetermined processing steps. In the later cases, it is not necessary to actually secure storing space. Although any one of the gain vector codebooks may be used in the present embodiment, the present embodiment will be explained below assuming that gain vector codebook 541 storing gain vector candidates shown in FIG. 7 is provided. Hereinafter, the j-th gain vector candidate of the plural of gain vector candidates stored in gain vector codebook 541, is represented as g(j,m). Here, m represents the m-th element of M elements forming a gain vector candidate.

Error calculating section 542 calculates the error E(j) according to following equation 6 using the gain vector received from gain vector forming section 153 and the gain vector candidate received from gain vector codebook 541, and outputs the error E(j) to searching section 543.

(Equation 6)

$$E(j) = \sum_{m=0}^{M-1} (gv(m) - g(j, m))^2 \quad [6]$$

In equation 6, m represents the subband number, and gv(m) represents a gain vector received from gain vector forming section 153.

Searching section 543 outputs a control signal to gain vector codebook 541 until the minimum value of the error E(j) received from error calculating section 542 is found, searches for the index $j_{opt}$ of when the error E(j) is minimized, and outputs the index $j_{opt}$ as gain encoded information to multiplexing section 155.

Figure 8:
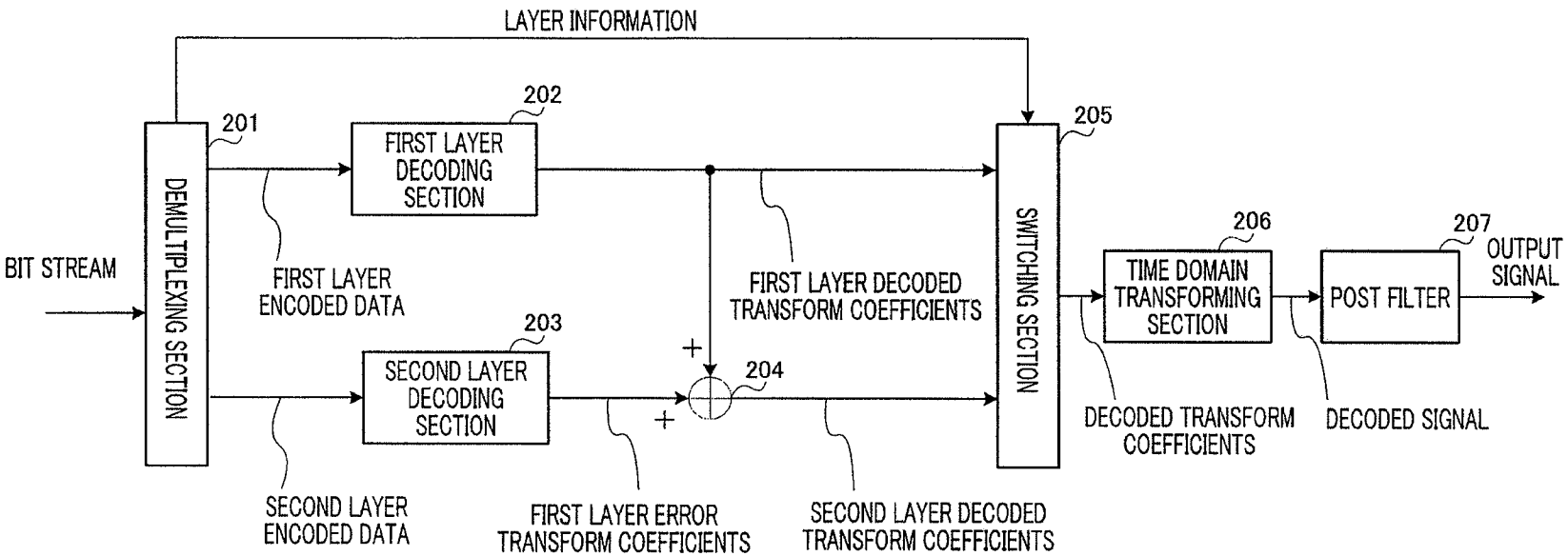
FIG. 8 is a block diagram showing the main configuration of a speech decoding apparatus according to Embodiment 1 of the present invention.

FIG. 8 is a block diagram showing the main configuration of speech decoding apparatus 200 according to the present embodiment.

In FIG. 8, speech decoding apparatus 200 has demultiplexing section 201, first layer decoding section 202, second layer decoding section 203, adder 204, switching section 205, time domain transforming section 206 and post filter 207.

Demultiplexing section 201 demultiplexes the bit stream transmitted from speech encoding apparatus 100 through a transmission channel, into the first layer encoded data and second layer encoded data, and outputs the first layer encoded data and the second layer encoded data to first layer decoding section 202 and second layer decoding section 203, respectively. However, there are cases depending on the state of the transmission channel (e.g. the occurrence of congestion) where part of encoded data such as the second layer encoded data or encoded data including the first layer encoded data and second layer encoded data, is lost. Then, demultiplexing section 201 decides whether only the first layer encoded data is included in the received encoded data or both the first layer encoded data and second layer encoded data are included, and outputs "1" as layer information in the former case and outputs "2" as layer information in the latter case. Further, when deciding that all encoded data including the first layer encoded data and second layer encoded data is lost, demultiplexing section 201 performs predetermined compensation processing to generate the first layer encoded data and second layer encoded data, outputs the first layer encoded data and second layer encoded data to first layer decoding section 202 and second layer decoding section 203, respectively, and outputs "2" as layer information, to switching section 205.

First layer decoding section 202 performs decoding processing using the first layer encoded data received from demultiplexing section 201, and outputs the resulting first layer decoded transform coefficients to adder 204 and switching section 205.

Second layer decoding section 203 performs decoding processing using the second layer encoded data received from demultiplexing section 201, and outputs the resulting first layer error transform coefficients to adder 204.

Adder 204 adds the first layer decoded transform coefficients received from first layer decoding section 202 and the first layer error transform coefficients received from second layer decoding section 203, and outputs the resulting second layer decoded transform coefficients to switching section 205.

Switching section 205 outputs the first layer decoded transform coefficients as a decoded transform coefficients to time domain transforming section 206 when layer information received from demultiplexing section 201 shows "1," and outputs the second layer decoded transform coefficients as decoded transform coefficients to time domain transforming section 206 when layer information shows "2."

Time domain transforming section 206 transforms the decoded transform coefficients received from switching section 205, into a time domain signal, and outputs the resulting decoded signal to post filter 207.

Post filter 207 performs post filtering processing such as formant emphasis, pitch emphasis and spectral tilt adjustment, with respect to the decoded signal received from time domain transforming section 206, and outputs the result as decoded speech.

Figure 9:
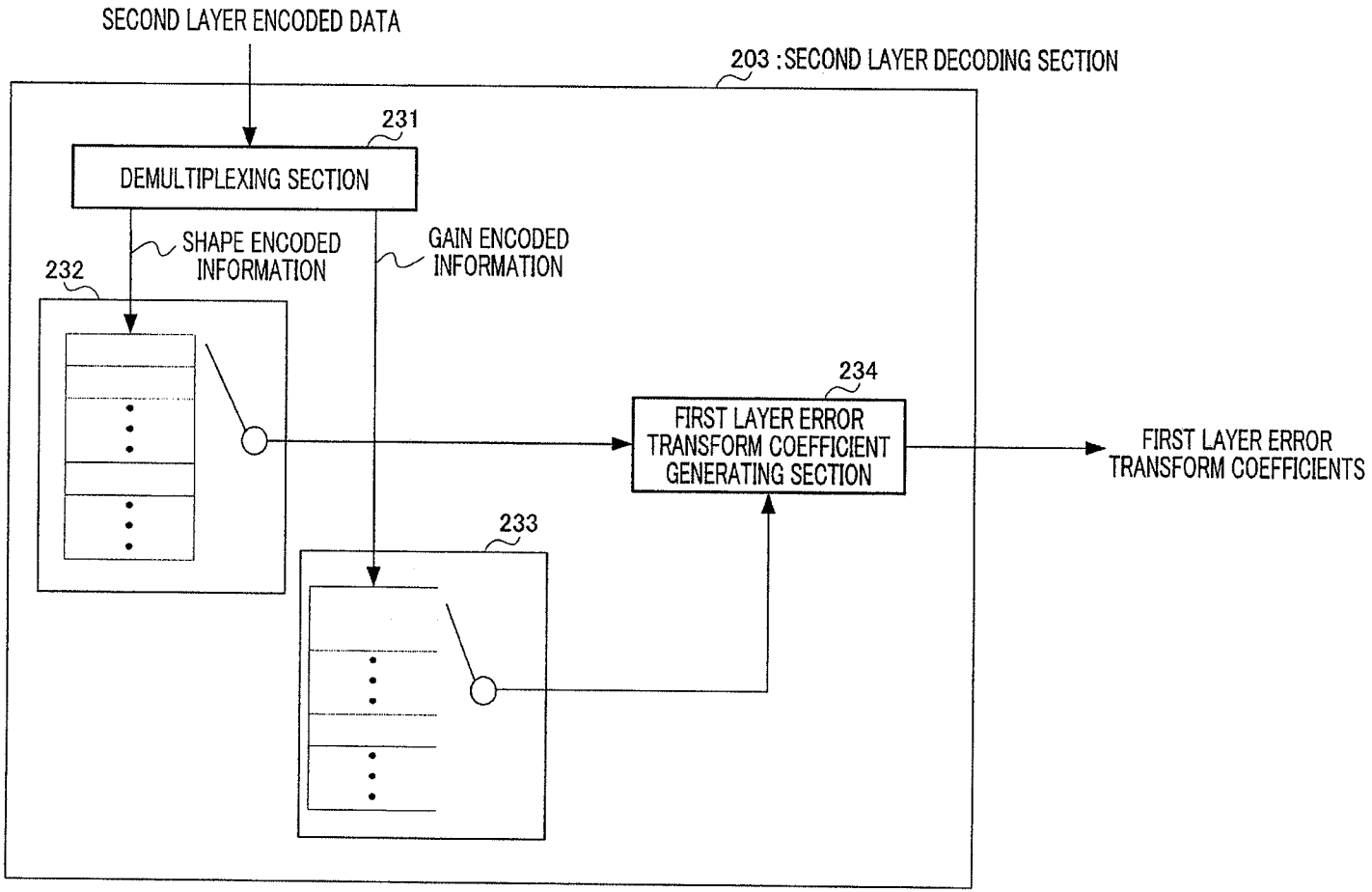
FIG. 9 is a block diagram showing the configuration inside a second layer decoding section according to Embodiment 1 of the present invention.

FIG. 9 is a block diagram showing the configuration inside second layer decoding section 203.

In FIG. 9, second layer decoding section 203 has demultiplexing section 231, shape vector codebook 232, gain vector codebook 233, and first layer error transform coefficient generating section 234.

Demultiplexing section 231 further demultiplexes the second layer encoded data received from demultiplexing section 201 into shape encoded information and gain encoded information, and outputs the shape encoded information and gain encoded information to shape vector codebook 232 and gain vector codebook 233, respectively.

Shape vector codebook 232 has shape vector candidates identical to a plural of shape vector candidates provided in shape vector codebook 521 in FIG. 4, and outputs the shape vector candidate shown by the shape encoded information received from demultiplexing section 231, to first layer error transform coefficient generating section 234.

Gain vector codebook 233 has gain vector candidates identical to a plural of gain vector candidates provided in gain vector codebook 541 in FIG. 7, and outputs the gain vector candidate shown by the gain encoded information received from demultiplexing section 231, to first layer error transform coefficient generating section 234.

First layer error transform coefficient generating section 234 multiplies the shape vector candidate received from shape vector codebook 232 by the gain vector candidate received from gain vector codebook 233 to generate the first layer error transform coefficients, and output the first layer error transform coefficients to adder 204. To be more specific, the m-th element of the M elements forming the gain vector candidate received from gain vector codebook 233, that is, the target gain of the m-th subband transform coefficients, is multiplied upon the m-th shape vector candidate sequentially received from shape vector codebook 232. Here, as described above, M represents the total number of subbands.

In this way, the present embodiment employs a configuration of encoding the spectral shape of a target signal (i.e. the first layer error transform coefficients with the present embodiment) on a per subband basis (shape vector encoding), then calculating a target gain (i.e. ideal gain) that minimizes the distortion between the target signal and an encoded shape vector and encoding the target gain (target gain encoding). By this means, compared to the scheme like a conventional art of encoding the energy component of a target signal on a per subband basis (gain or scale factor encoding), normalizing the target signal using the encoded energy component and then encoding the spectral shape (shape vector encoding), the present invention that encodes the target gain for minimizing the distortion with respect to a target signal, can essentially minimize coding distortion. Further, the target gain is a parameter that can be calculated after the shape vector is encoded as shown in equation 5, and, therefore, while the coding scheme like a conventional art of performing shape vector encoding temporally subsequent to gain information encoding cannot use the target gain as the target for encoding gain information, the present embodiment makes it possible to use the target gain as the target for encoding gain information and can further minimize coding distortion.

Further, the present embodiment employs a configuration of forming and encoding one gain vector using target gains of a plurality of adjacent subbands. Energy information between adjacent subbands of a target signal is similar, and the similarity of target gains between adjacent subbands is high likewise. Therefore, ununiformed density distribution of gain vectors is produced in vector space. By arranging gain vector candidates included in the gain codebook to be adapted to this ununiformed density distribution, it is possible to reduce coding distortion of the target gain.

In this way, according to the present embodiment, it is possible to reduce coding distortion of the target signal and, consequently, improve sound quality of decoded speech. Further, the present embodiment can accurately encode spectral shapes for spectra of signals with strong tonality such as vowels of speech and music signals.

Further, with a conventional art, the spectral amplitude is controlled by using two parameters, the subband gain and shape vector. This can be construed that the spectral amplitude is represented separately by two parameters, the subband gain and shape vector. By contrast with this, with the present embodiment, the spectral amplitude is controlled only by one parameter of the target gain. Further, this target gain is an ideal gain that minimizes the coding distortion with respect to the encoded shape vector. Consequently, it is possible to perform encoding efficiently compared to a conventional art and realize high quality sound even when the bit rate is low.

Further, although a case has been explained with the present embodiment as an example where the frequency domain is divided into a plurality of subbands by subband forming section 151 and encoding is performed on a per subband basis, the present invention is not limited to this. By performing shape vector encoding temporally prior to gain vector encoding, a plurality of subbands may be encoded collectively, so that, similar to the present embodiment, it is possible to provide an advantage of more accurately encoding the spectral shapes of signals of strong tonality such as vowels. For example, a configuration may be possible where shape vector encoding is performed first, then the shape vector is divided into subbands and target gains are calculated on a per subband basis to form a gain vector and the gain vector is encoded.

Further, although a case has been explained with the present embodiment as an example where second layer encoding section 105 has multiplexing section 155 (see FIG. 2), the present invention is not limited to this, and shape vector encoding section 152 and gain vector encoding section 154 may output shape encoded information and gain encoded information directly to multiplexing section 106 of speech encoding apparatus 100 (see FIG. 1). By contrast with this, second layer decoding section 203 may not include demultiplexing section 231 (see FIG. 9), and demultiplexing section 201 of speech decoding apparatus 200 (see FIG. 8) may demultiplex and output shape encoded information and gain encoded information using a bit stream, directly to shape vector codebook 232 and gain vector codebook 233, respectively.

Further, although a case has been explained with the present embodiment as an example where cross-correlation calculating section 522 calculates the cross-correlation ccor (i) according to equation 2, the present invention is not limited to this and cross-correlation calculating section 522 may calculate the cross-correlation ccor(i) according to following equation 7 to increase the contribution of a perceptually important spectrum by applying a great weight to the perceptually important spectrum.

(Equation 7)

$$ccor(i) = \sum_{k=0}^{F(m+1)-F(m)-1} w(k) \cdot e(m, k) \cdot c(i, k) \quad [7]$$

In equation 7, w(k) represents a weight related to the characteristics of human perception and increases when a frequency has a higher importance in perceptual characteristics.

Further, similarly, auto-correlation calculating section 523 may calculate the auto-correlation acor(i) according to following equation 8 to increase the contribution of a perceptually important spectrum by applying a great weight to the perceptually important spectrum.

(Equation 8)

$$acor(i) = \sum_{k=0}^{F(m+1)-F(m)-1} w(k) \cdot c(i, k)^2 \quad [8]$$

Further, similarly, error calculating section 542 may calculate the error E(j) according to following equation 9 to increase the contribution of a perceptually important spectrum by applying a great weight to the perceptually important spectrum.

(Equation 9)

$$E(j) = \sum_{m=0}^{M-1} w(m) \cdot (gv(m) - g(j, m))^2 \quad [9]$$

As weights in equation 7, equation 8 and equation 9, for example, weights may be found and used by utilizing human perceptual loudness characteristics or perceptual masking threshold calculated based on an input signal or a decoded signal of a lower layer (i.e. first layer decoded signal).

Further, although a case has been explained with the present embodiment as an example where shape vector encoding section 152 has auto-correlation calculating section 523, the present invention is not limited to this, and, when the auto-correlation coefficients acor(i) calculated according to equation 3 or the auto-correlation coefficients acor(i) calculated according to equation 8 become constants, the auto correlation acor(i) may be calculated in advance and used without providing auto-correlation calculating section 523.

(Embodiment 2)

The speech encoding apparatus and speech decoding apparatus according to Embodiment 2 of the present invention employ the same configuration and performs the same operation as speech encoding apparatus 100 and speech decoding apparatus 200 described in Embodiment 1, and Embodiment 2 differs from Embodiment 1 only in the shape vector codebook.

Figure 10:
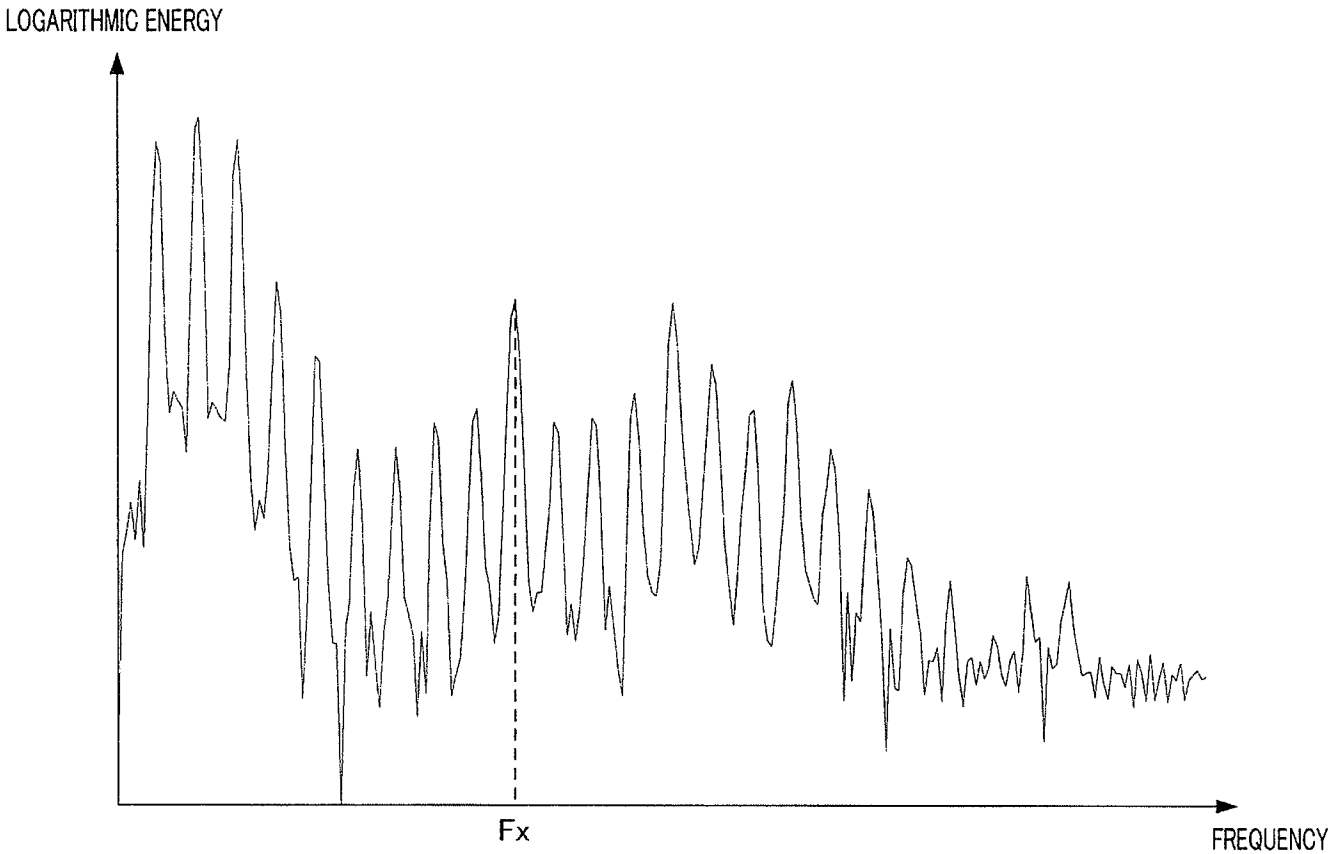
FIG. 10 illustrates a shape vector codebook according to Embodiment 2 of the present invention.

To explain the shape vector codebook according to the present embodiment, FIG. 10 illustrates the spectrum of the Japanese vowel "o" as an example of a vowel.

In FIG. 10, the horizontal axis is the frequency and the vertical axis is logarithmic energy of the spectrum. As shown in FIG. 10, in the spectrum of a vowel, multiple peak shapes are observed, showing strong tonality. Further, Fx is the frequency at which one of multiple peak shapes is placed.

Figure 11:
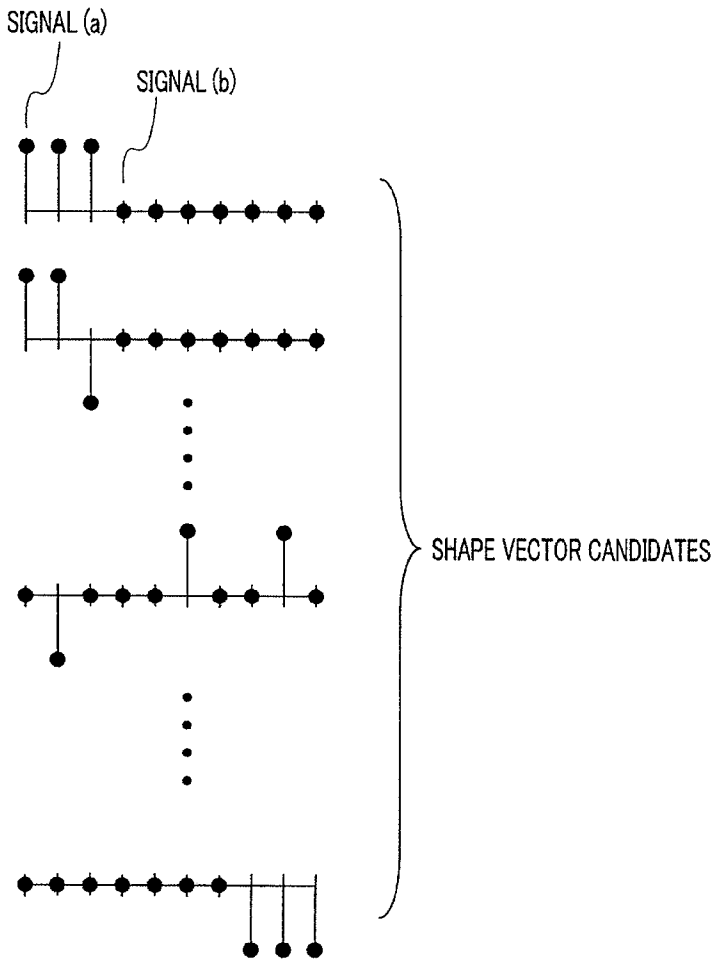
FIG. 11 illustrates multiple shape vector candidates included in the shape vector codebook according to Embodiment 2 of the present invention.

FIG. 11 illustrates a plural of shape vector candidates included in the shape vector codebook according to the present embodiment.

In FIG. 11, among shape vector candidates, (a) illustrates a sample (that is, a pulse) having an amplitude value "+1" or "−1" and (b) illustrates a sample having an amplitude value "0." A plurality of shape vector candidates shown in FIG. 11 include a plurality of pulses placed at arbitrary frequencies. Consequently, by searching for shape vector candidates shown in FIG. 11, it is possible to more accurately encode a spectrum of strong tonality shown in FIG. 10. To be more specific, a shape vector candidate is searched for and determined with respect to a signal of strong tonality shown in FIG. 10 such that the amplitude value corresponding to the frequency at which a peak shape is placed, for example, the amplitude value in the position of Fx shown in FIG. 10 assumes "+1" or "−1" (i.e. the sample (a) shown in FIG. 11) and the amplitude value of the frequency other than the peak shape assumes "0" (i.e. the sample (b) shown in FIG. 11).

With a conventional art of performing gain encoding temporally prior to shape vector encoding, a subband gain is quantized, a spectrum is normalized using the subband gain and then the fine component (i.e. shape vector) of the spectrum is encoded. When quantization distortion of the subband gain becomes significant by making the bit rate lower, the normalization effect becomes little and the dynamic range of the normalized spectrum cannot be decreased much. By this means, the quantization step in the following shape vector encoding section needs to be made coarse and, therefore, quantization distortion increases. Due to the influence of this quantization distortion, the peak shape of a spectrum attenuates (i.e. loss of the true peak shape), and the spectrum which does not form a peak shape is amplified and appears like the peak shape (i.e. appearance of a false peak shape). In this way, the frequency position of the peak shape changes, causing sound quality deterioration in a vowel portion of a speech signal with a strong peak and a music signal.

By contrast with this, the present embodiment employs a configuration of determining a shape vector first, then calculating a target gain and quantizing this target gain. When some elements of vectors include a shape vector represented by a pulse of +1 or −1 as in the present embodiment, determining the shape vector first means determining first the frequency position in which this pulse rises. The frequency position in which a pulse rises can be determined without the influence of gain quantization, and, consequently, the phenomenon where the true peak shape is lost or a false peak shape appears does not occur, so that it is possible to prevent the above-described problem with the conventional art.

In this way, the present embodiment employs a configuration of determining the shape vector first to perform shape vector encoding using the shape vector codebook formed with the shape vector including a pulse, so that it is possible to specify the frequency the spectrum having a strong peak and raise a pulse at this frequency. By this means, it is possible to encode the signals having the spectra of strong tonality such as vowels of speech signals and music signals in high quality.

(Embodiment 3)

Embodiment 3 of the present invention differs from Embodiment 1 in selecting a range (i.e. region) of strong tonality in the spectrum of a speech signal and encoding only the selected range.

The speech encoding apparatus according to Embodiment 3 of the present invention employs the same configuration as speech encoding apparatus 100 according to Embodiment 1 (see FIG. 1), and differs from speech encoding apparatus 100 only in including second layer encoding section 305 instead of second layer encoding section 105. Therefore, the overall configuration of the speech encoding apparatus according to the present embodiment is not shown, and detailed explanation thereof will be omitted.

Figure 12:
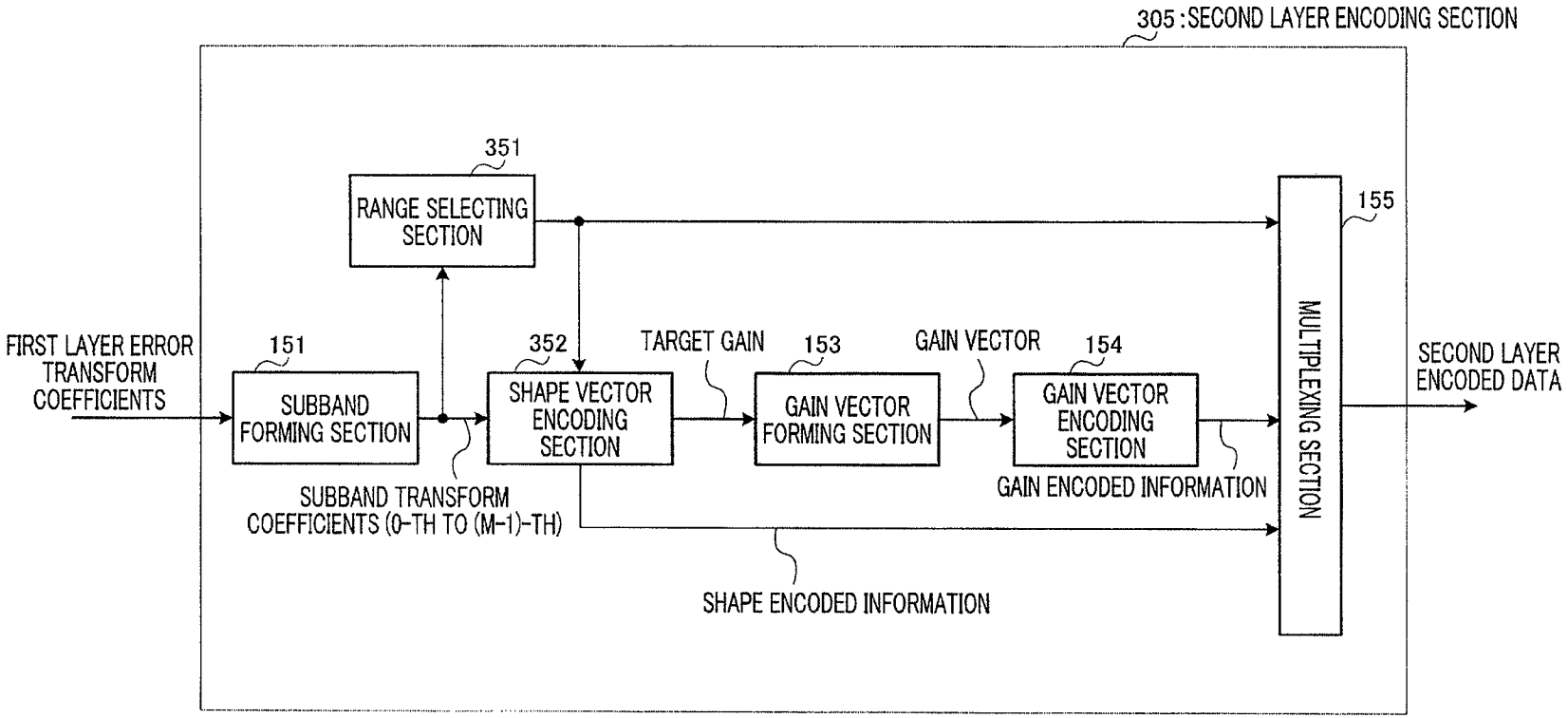
FIG. 12 is a block diagram showing the configuration inside the second layer encoding section according to Embodiment 3 of the present invention.

FIG. 12 is a block diagram showing the configuration inside second layer encoding section 305 according to the present embodiment. Further, second layer encoding section 305 employs the same basic configuration as second layer encoding section 105 described in Embodiment 1 (see FIG. 1), and the same components will be assigned the same reference numerals and explanation thereof will be omitted.

Second layer encoding section 305 differs from second layer encoding section 105 according to Embodiment 1 in further including range selecting section 351. Further, shape vector encoding section 352 of second layer encoding section 305 differs from shape vector encoding section 152 of second layer encoding section 105 in part of processing, and different reference numerals will be assigned to show this difference.

Range selecting section 351 forms a plurality of ranges using an arbitrary number of adjacent subbands from M subband transform coefficients received from subband forming section 151, and calculates tonality in each range. Range selecting section 351 selects the range of the strongest tonality, and outputs range information showing the selected range, to multiplexing section 155 and shape vector encoding section 352. Further, range selecting processing in range selecting section 351 will be explained in detail later.

Shape vector encoding section 352 differs from shape vector encoding section 152 according to Embodiment 1 only in selecting subband transform coefficients included a range from subband transform coefficients received from subband forming section 151, based on range information received from range selecting section 351, and performing shape vector quantization with respect to the selected subband transform coefficients, and detailed explanation thereof will be omitted here.

Figure 13:
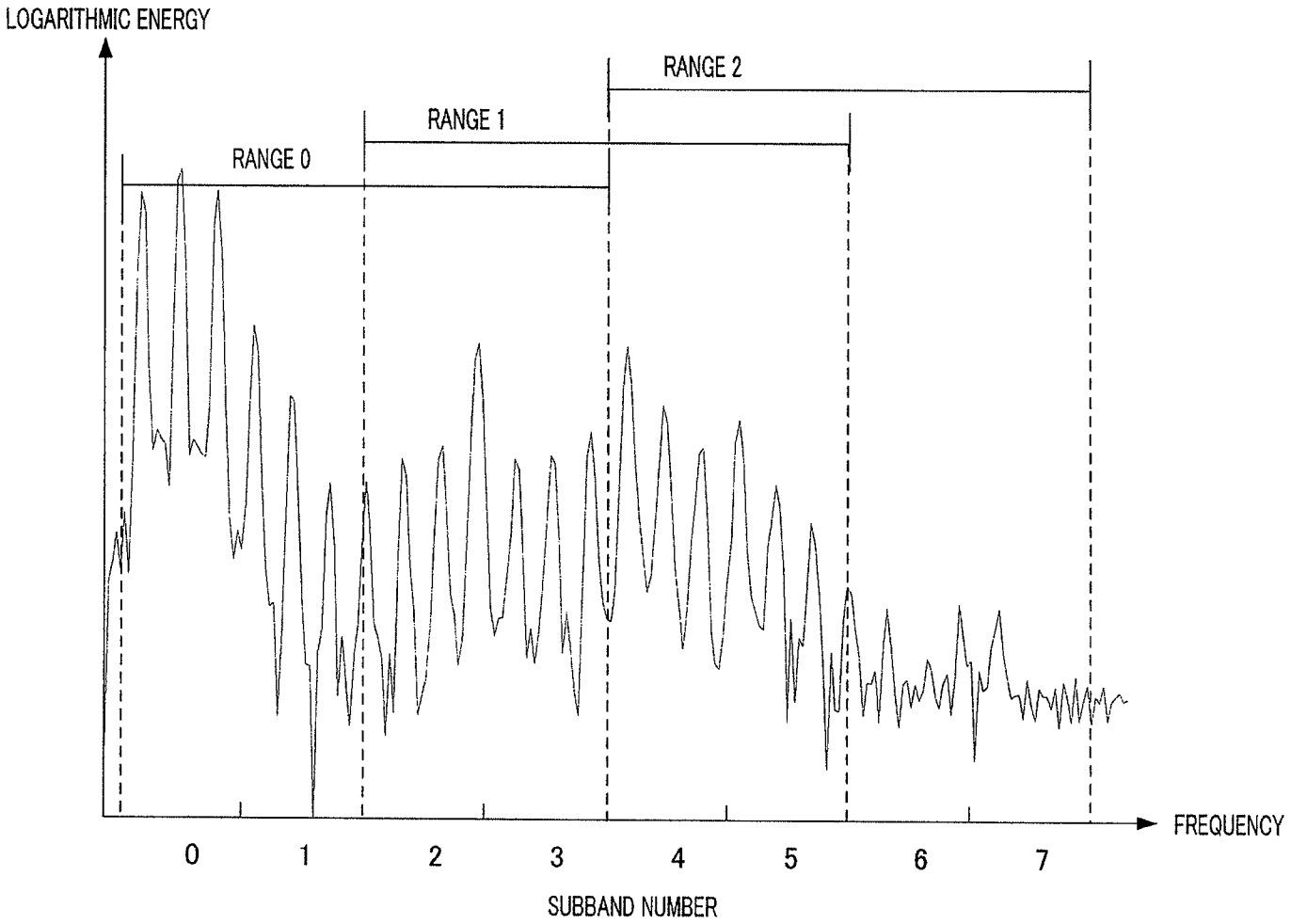
FIG. 13 illustrates range selecting processing in a range selecting section according to Embodiment 3 of the present invention.

FIG. 13 illustrates range selecting processing in range selecting section 351.

In FIG. 13, the horizontal axis is the frequency and the vertical axis is logarithmic energy. Further, FIG. 13 illustrates a case where the total number of subbands M is "8," range 0 is formed using the 0-th subband to the third subband, range 1 is formed using the second subband to the fifth subband and range 2 is formed using the fourth subband to the seventh subband. As an indicator to evaluate tonality in a predetermined range, range selecting section 351 calculates a spectral flatness measure (SFM) represented using the ratio of the geometric average and arithmetic average of a plurality of subband transform coefficients included in a predetermined range. The SFM assumes a value between "0" and "1" and the value closer to "0" shows strong tonality. Consequently, the SFM is calculated in each range and the range having the closest SFM to "0" is selected.

The speech decoding apparatus according to the present embodiment employs the same configuration as speech decoding apparatus 200 according to Embodiment 1 (see FIG. 8), and differs from speech decoding apparatus 200 only in including second layer decoding section 403 instead of second layer decoding section 203. Therefore, the overall configuration of the speech decoding apparatus according to the present embodiment will not be illustrated, and detailed explanation thereof will be omitted.

Figure 14:
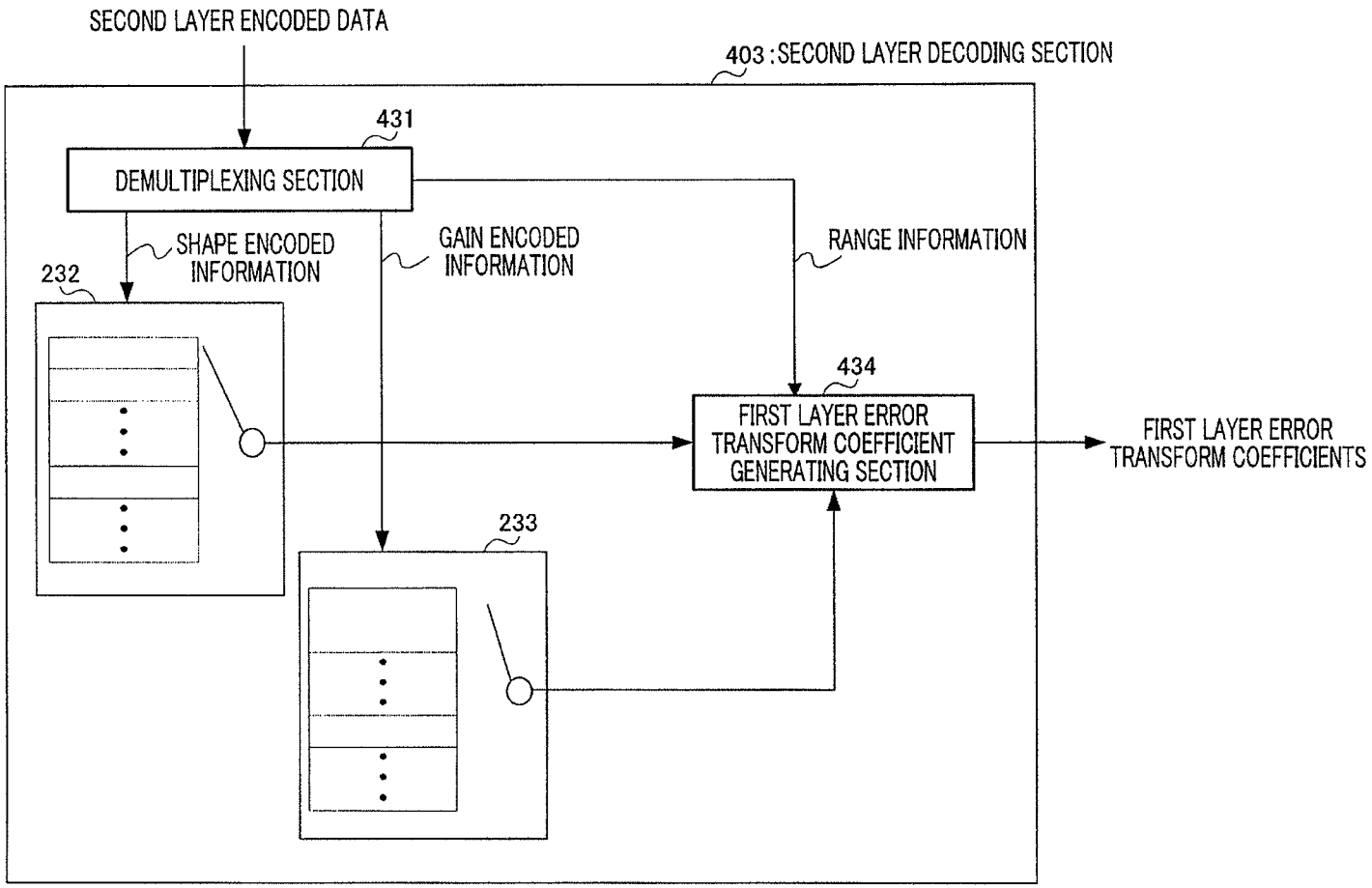
FIG. 14 is a block diagram showing the configuration inside the second layer decoding section according to Embodiment 3 of the present invention.

FIG. 14 is a block diagram showing the configuration inside second layer decoding section 403 according to the present embodiment. Further, second layer decoding section 403 employs the same basic configuration as second layer decoding section 203 described in Embodiment 1, and the same components will be assigned the same reference numerals and explanation thereof will be omitted.

Demultiplexing section 431 and first layer error transform coefficient generating section 434 of second layer decoding section 403 differ from demultiplexing section 231 and first layer error transform coefficient generating section 234 of second layer decoding section 203 in part of processing, and different reference numerals will be assigned to show this difference.

Demultiplexing section 431 differs from demultiplexing section 231 described in Embodiment 1 in demultiplexing and outputting range information in addition to shape encoded information and gain encoded information, to first layer error transform coefficient generating section 434, and detailed explanation thereof will be omitted.

First layer error transform coefficient generating section 434 multiplies the shape vector candidate received from shape vector codebook 232, with the gain vector candidate received from gain vector codebook 233 to generate the first layer error transform coefficients, arranges this first layer error transform coefficients in the subband included in the range shown by range information and outputs the result to adder 204.

In this way, according to the present embodiment, the speech encoding apparatus selects the range of the strongest tonality and encodes the shape vector temporally prior to the gain of each subband in the selected range. By this means, the spectral shapes of signals with strong tonality such as vowels of speech or music signals are encoded more accurately and encoding is performed only in the selected range, so that it is possible to reduce the coding bit rate.

Further, although a case has been explained with the present embodiment as an example where an SFM is calculated as an indicator to evaluate tonality in each predetermined range, the present invention is not limited to this. For example, by taking an advantage of the high association between the average energy in the predetermined range and the strength of tonality, the average energy of transform coefficients included in the predetermined range may be calculated as the indicator of tonality evaluation. By this means, it is possible to reduce the computational complexity compared to the case where an SFM is calculated.

To be more specific, range selecting section 351 calculates energy $E_R(j)$ of the first layer error transform coefficients $e_1(k)$ included in the range j, according to following equation 10.

(Equation 10)

$$E_R(j) = \sum_{k=FRL(j)}^{FRH(j)} e_1(k)^2 \quad [10]$$

In this equation, j represents the identifier to specify the range, FRL(j) represents the lowest frequency in range j and FRH(j) represents the highest frequency in range j. Range selecting section 351 calculates the energies $E_R(j)$ of the ranges in this way, then specifies the range where the energy of the first layer error transform coefficients is the highest, and encodes the first layer error transform coefficients included in this range.

Further, the energy of the first layer error transform coefficients may be calculated according to following equation 11 by performing weighting taking the characteristics of human perception into account.

(Equation 11)

$$E_R(j) = \sum_{k=FRL(j)}^{FRH(j)} w(k) \cdot e_1(k)^2 \quad [11]$$

In such a case, the weight w(k) is increased greater for a frequency of higher importance in perceptual characteristics such that the range including this frequency is likely to be selected, and the weight w(k) is decreased for the frequency of lower importance such that the range including this frequency is not likely to be selected. By this means, a perceptually important band is likely to be selected preferentially, so that it is possible to improve sound quality of decoded speech. As this weight w(k), weights may be found and used utilizing human perceptual loudness characteristics or perceptual masking threshold calculated based on, for example, an input signal or a decoded signal of a lower layer (i.e. first layer decoded signal).

Further, range selecting section 351 may be configured to select a range from ranges arranged at lower frequencies than a predetermined frequency (i.e. reference frequency).

Figure 15:
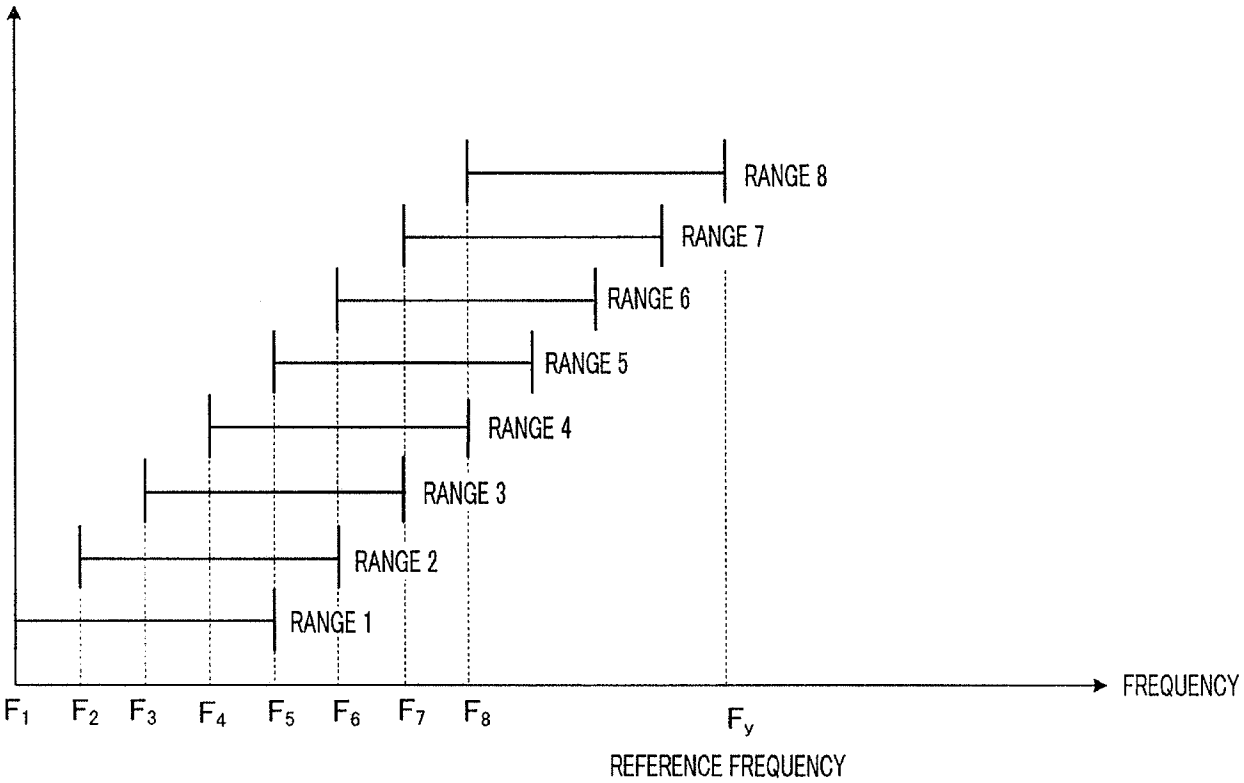
FIG. 15 shows a variation of the range selecting section according to Embodiment 3 of the present invention.

FIG. 15 illustrates a method of selecting in range selecting section 351 a range from ranges arranged at lower frequencies than a predetermined frequency (i.e. reference frequency).

FIG. 15 shows the case as an example where eight selection range candidates are arranged in lower bands than the predetermined reference frequency Fy. These eight ranges are each formed with a band of a predetermined length starting from one of F1, F2 . . . and F8 as the base point, and range selecting section 351 selects one range from these eight candidates based on the above-described selection method. By this means, ranges positioned at lower frequencies than the predetermined frequency Fy are selected. In this way, advantages of performing encoding emphasizing the low frequency band (or middle-low frequency band) are as follows.

In the harmonic structure which is one characteristic of a speech signal (or is referred to as "harmonics structure"), that is, in the structure in which the spectrum shows peaks at given frequency intervals, peaks appear sharply in a low frequency band compared to a high frequency band. Similar peaks are seen in the quantization error (i.e. error spectrum or error transform coefficients) produced in encoding processing, and peaks appear sharply in a low frequency band compared to a high frequency band. Therefore, when energy of an error spectrum in a low frequency band is lower than in a high frequency band, peaks of an error spectrum are sharp and, therefore, the error spectrum is likely to exceed a perceptual masking threshold (a threshold at which people can perceive sound), causing perceptual sound quality deterioration. That is, even when energy of the error spectrum is low, the perceptual sensitivity in a low frequency band is higher than in a high frequency band. Consequently, range selecting section 351 employs a configuration of selecting a range from candidates arranged at lower frequencies than a predetermined frequency, so that it is possible to specify the range which is the target to be encoded, from a low frequency band in which peaks of the error spectrum are sharp and improve the sound quality of decoded speech.

Further, as a method of selecting the range which is the target to be encoded, the range of the current frame may be selected in association with the range selected in the past frame. For example, there are methods of (1) determining the range of the current frame from ranges positioned in the vicinities of the range selected in the previous frame, (2) rearranging the range candidates for the current frame in the vicinity of the range selected in the previous frame to determine the range of the current frame from the rearranged range candidates, and (3) transmitting range information once every several frames and using the range shown by range information transmitted in the past in the frame in which range information is not transmitted (discontinuous transmission of range information).

Figure 16:
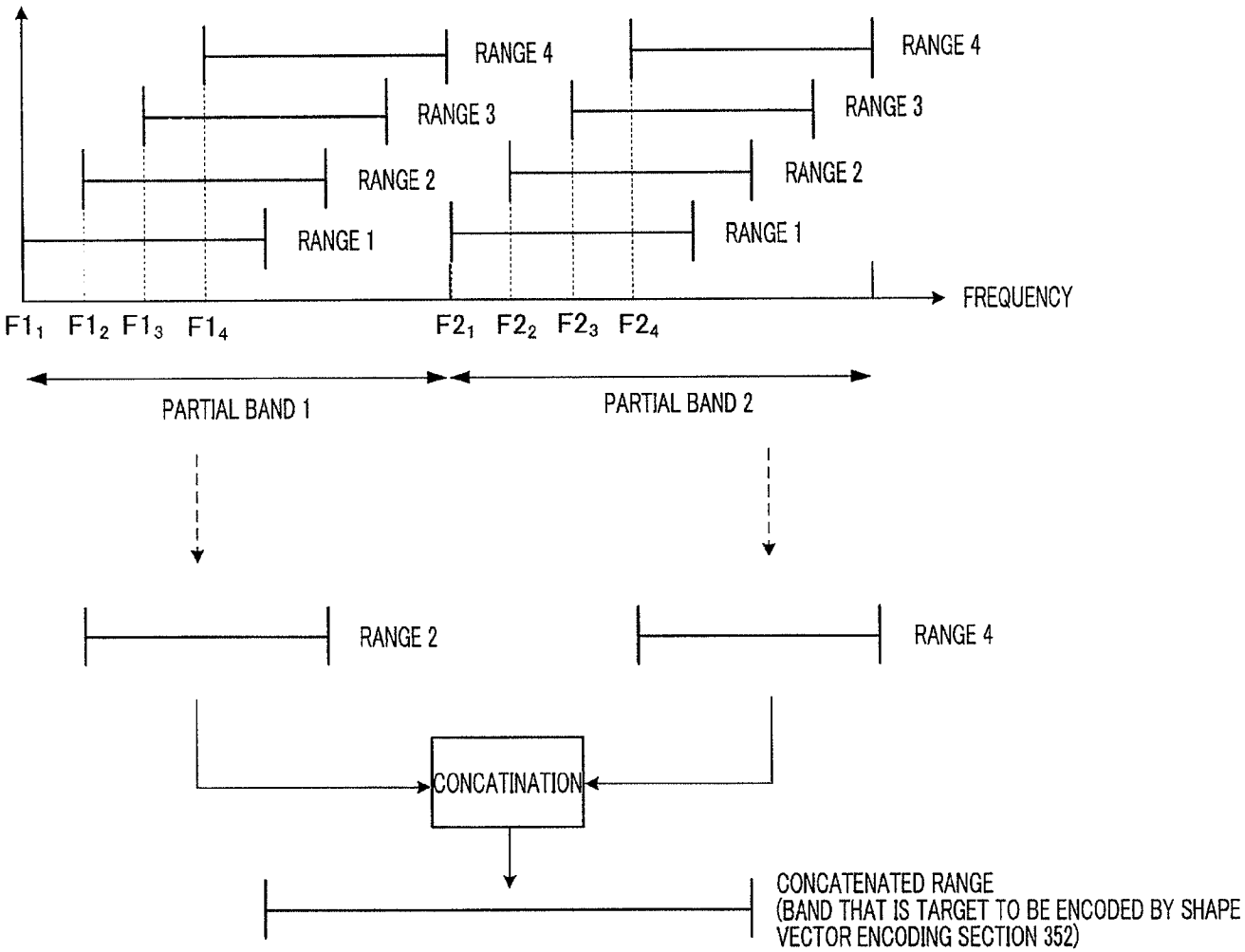
FIG. 16 shows a variation of a range selecting method in the range selecting section according to Embodiment 3 of the present invention.

Further, range selecting section 351 may divide a full band into a plurality of partial bands in advance as shown in FIG. 16 to select one range from each partial band and concatenates the ranges selected from each partial band to make this concatenated range the target to be encoded. FIG. 16 illustrates a case where the number of partial bands is two, and partial band 1 is configured to cover a low frequency band and partial band 2 is configured to cover a high frequency band. Further, partial band 1 and partial band 2 are each formed with a plurality of ranges. Range selecting section 351 selects one range from each of partial band 1 and partial band 2. For example, as shown in FIG. 16, range 2 is selected in partial band 1 and range 4 is selected in partial band 2. Hereinafter, information showing the range selected from partial band 1 is referred to as "first partial band range information," and information showing the range selected from partial band 2 is referred to as "second partial band range information." Next, range selecting section 351 concatenates the range selected from partial band 1 and the range selected from partial band 2 to form a concatenated range. This concatenated range becomes the range selected in range selecting section 351, and shape vector encoding section 352 performs shape vector encoding with respect to this concatenated range.

Figure 17:
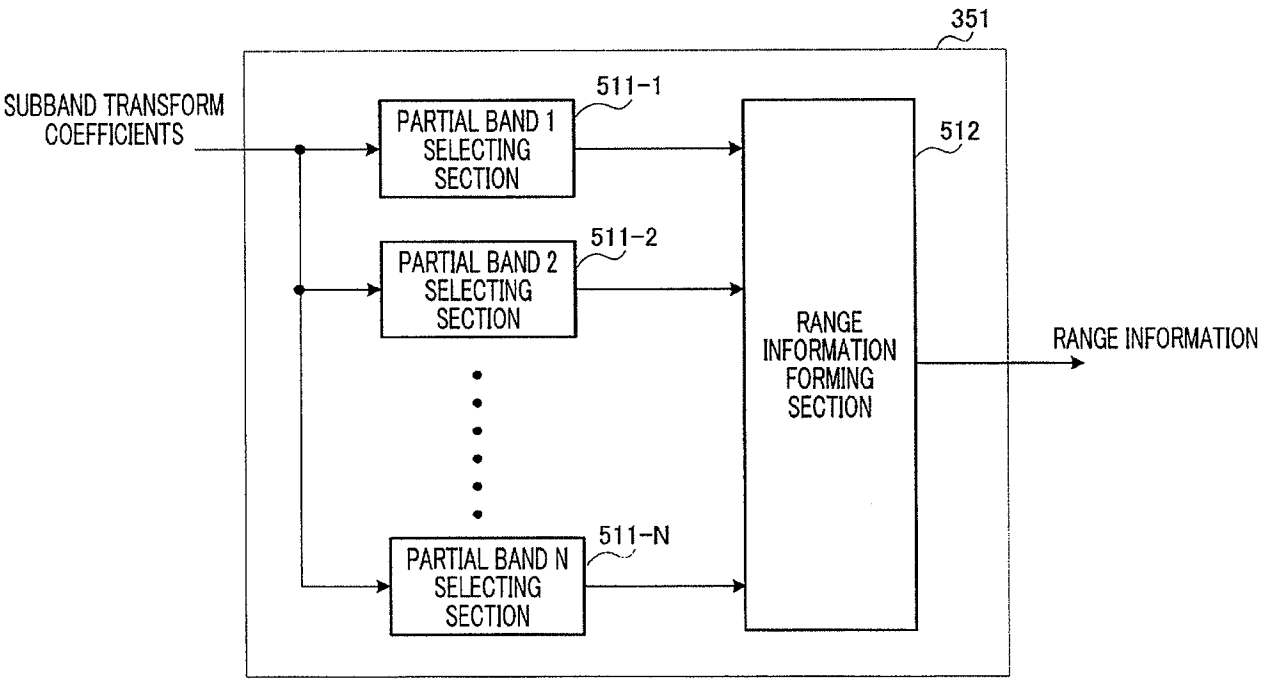
FIG. 17 is a block diagram showing a variation of the configuration of the range selecting section according to Embodiment 3 of the present invention.

FIG. 17 is a block diagram showing the configuration of range selecting section 351 supporting the case where the number of partial bands is N. In FIG. 17, the subband transform coefficients received from subband forming section 151 is given to partial band 1 selecting section 511-1 to partial band N selecting section 511-N. Each partial band n selecting section 511-n (where n=1 to N) selects one range from each partial band n, and outputs information showing the selected range, that is, the n-th partial band range information, to range information forming section 512. Range information forming section 512 acquires the concatenated range by concatenating the ranges shown by each n-th partial band range information (where n=1 to N) received from partial band 1 selecting section 511-1 to partial band N selecting section 511-N. Then, range information forming section 512 outputs information showing the concatenated range as range information, to shape vector encoding section 352 and multiplexing section 155.

Figure 18:
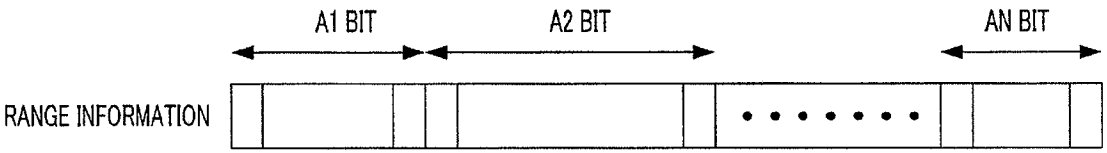
FIG. 18 illustrates how range information is formed in the range information forming section according to Embodiment 3 of the present invention.

FIG. 18 illustrates how range information is formed in range information forming section 512. As shown in FIG. 18, range information forming section 512 forms range information by arranging the first partial band range information (i.e. A1 bit) to the N-th partial band range information (i.e. AN bit) in order. Here, the bit length An of each n-th partial band range information is determined based on the number of candidate ranges included in each partial band n and may assume a different value.

Figure 19:
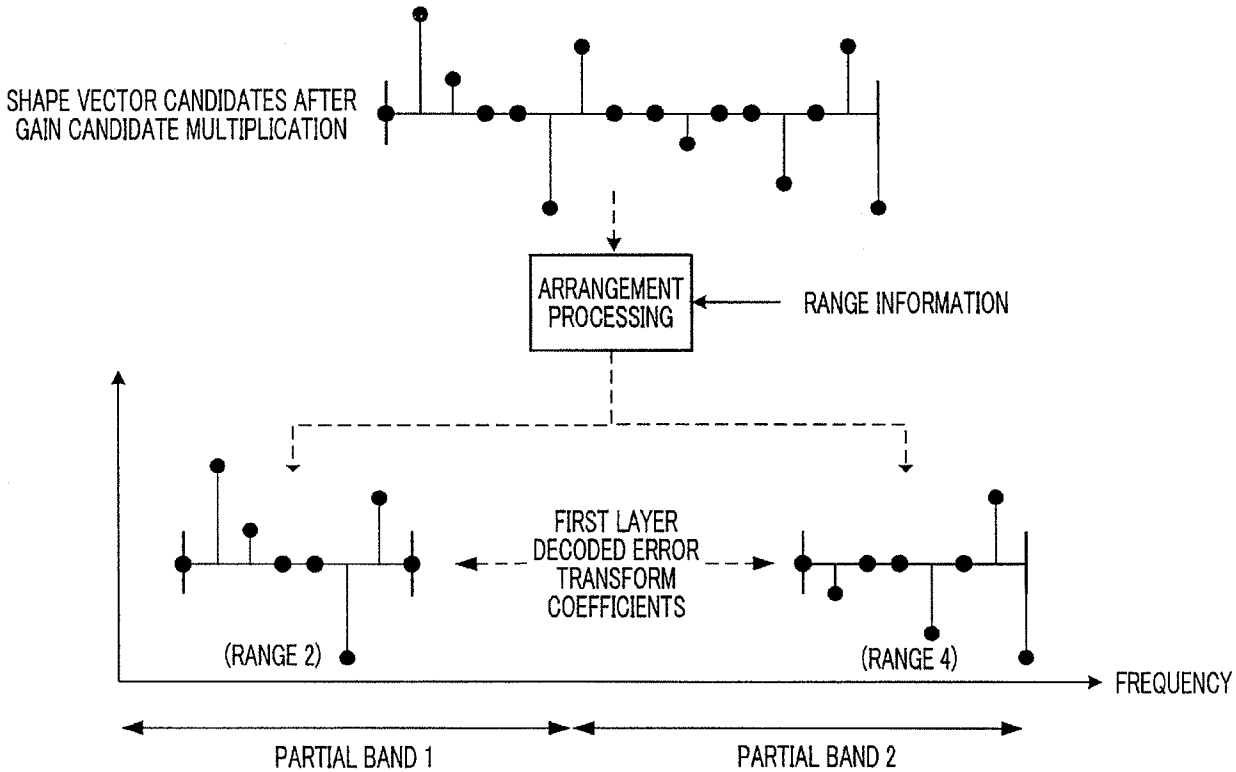
FIG. 19 illustrates the operation of a variation of a first layer error transform coefficient generating section according to Embodiment 3 of the present invention.

FIG. 19 illustrates the operation of first layer error transform coefficient generating section 434 (see FIG. 14) supporting range selecting section 351 shown in FIG. 17. Here, a case will be explained as an example where the number of partial bands is two. First layer error transform coefficient generating section 434 multiplies the shape vector candidate received from shape vector codebook 232 with the gain vector candidate received from gain vector codebook 233. Then, first layer error transform coefficient generating section 434 arranges the above shape vector candidate after gain multiplication, in each range shown by each range information of partial band 1 and partial band 2. The signal found in this way is outputted as the first layer error transform coefficients.

The range selecting method shown in FIG. 16 determines one range from each partial band and can arrange at least one decoded spectrum in each partial band. Consequently, by setting in advance a plurality of bands for which sound quality needs to be improved, it is possible to improve the quality of decoded speech compared to the range selecting method of selecting only one range from the full band. For example, the range selecting method shown in FIG. 16 is effective when, for example, quality improvement in both a low frequency band and high frequency band needs to be realized at the same time.

Figure 20:
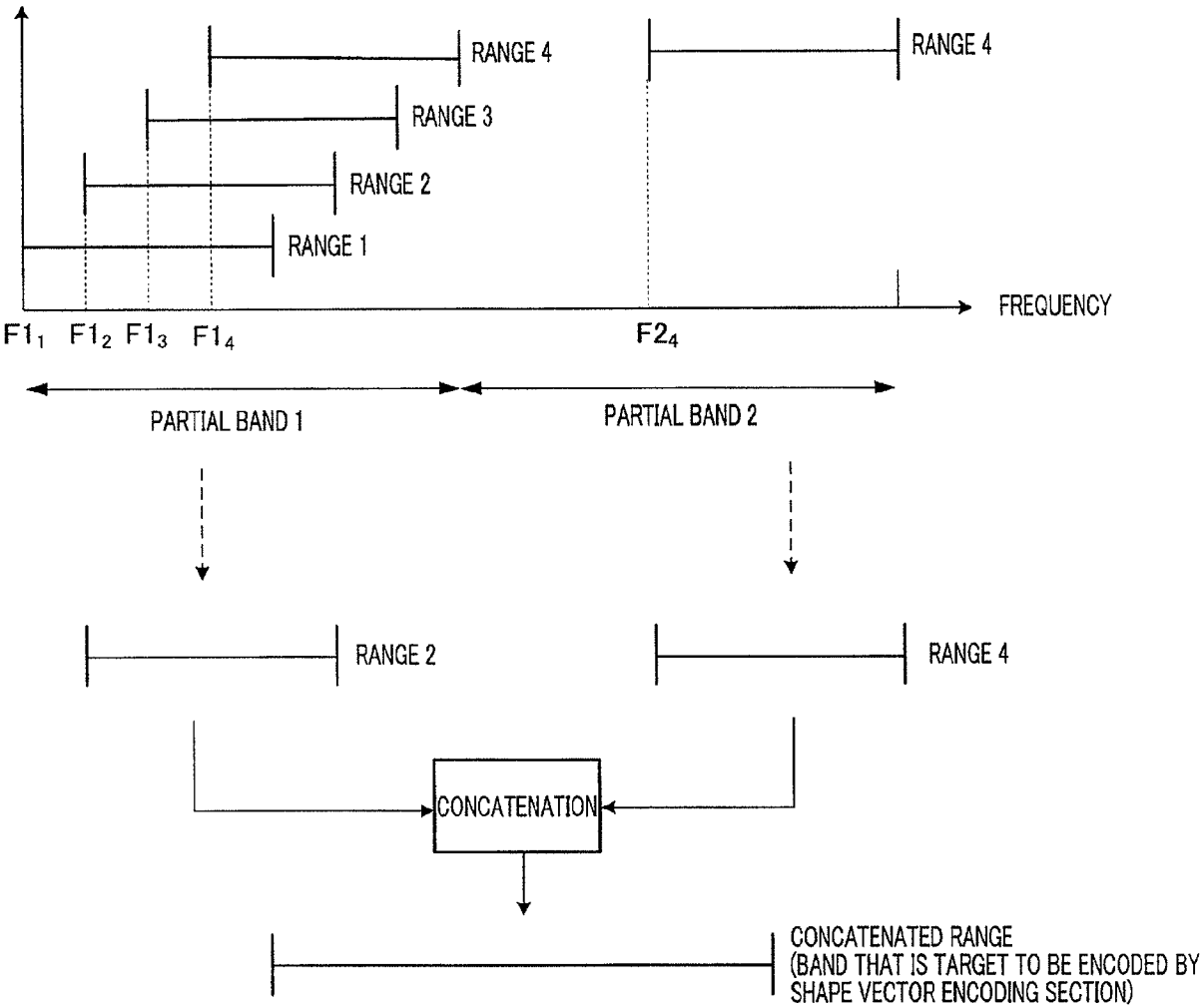
FIG. 20 shows a variation of the range selecting method in the range selecting section according to Embodiment 3 of the present invention.

Further, as a variation of the range selecting method shown in FIG. 16, a fixed range may be selected at all times in a specific partial band as illustrated in FIG. 20. With the example shown in FIG. 20, range 4 is selected at all times in partial band 2 and forms part of the concatenated range. Similar to the effect of the range selecting method shown in FIG. 16, the range selecting method shown in FIG. 20 can set in advance a band for which sound quality needs to be improved and, for example, partial band range information of partial band 2 is not required, so that it is possible to reduce the number of bits for representing range information.

Further, although FIG. 20 shows a case as an example where a fixed range is selected at all times in a high frequency band (partial band 2), the present invention is not limited to this, and the fixed range may be selected at all times in a low frequency band (i.e. partial band 1) and, further, a fixed range may be selected at all times in the partial band of the middle frequency band that is not shown in FIG. 20.

Figure 21:
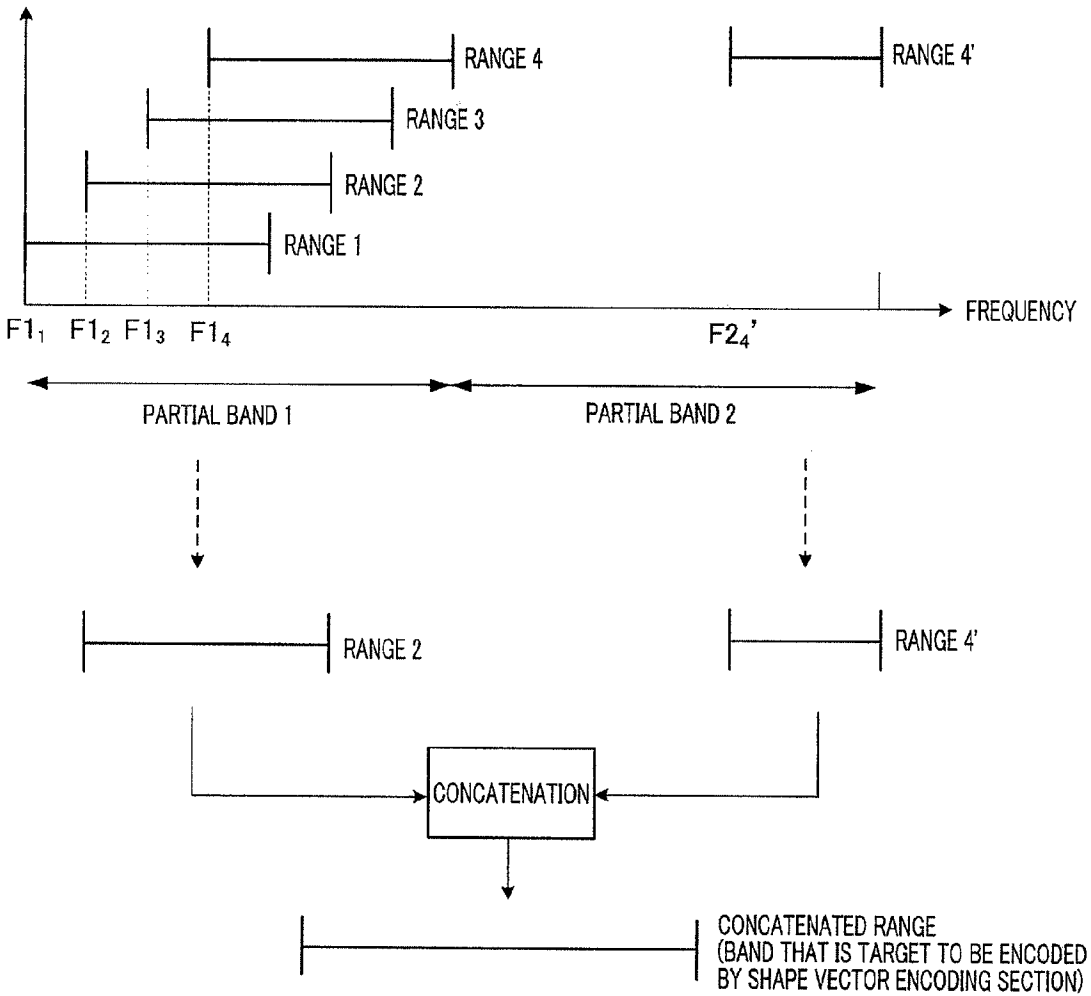
FIG. 21 shows a variation of the range selecting method in the range selecting section according to Embodiment 3 of the present invention.

Further, as variations of the range selecting methods shown in FIG. 16 and FIG. 20, the bandwidths of candidate ranges included in each partial band may be different. FIG. 21 illustrates a case where the bandwidth of the candidate range included in partial band 2 are shorter than candidate ranges included in partial band 1.

(Embodiment 4)

Embodiment 4 of the present invention decides the degree of tonality on a per frame basis, and determines the order of shape vector encoding and gain encoding depending on the decision result.

The speech encoding apparatus according to Embodiment 4 of the present invention employs the same configuration as speech encoding apparatus 100 according to Embodiment 1 (see FIG. 1), and differs from speech encoding apparatus 100 only in including second layer encoding section 505 instead of second layer encoding section 105. Therefore, the overall configuration of the speech encoding apparatus according to the present invention is not shown, and detailed explanation thereof will be omitted.

Figure 22:
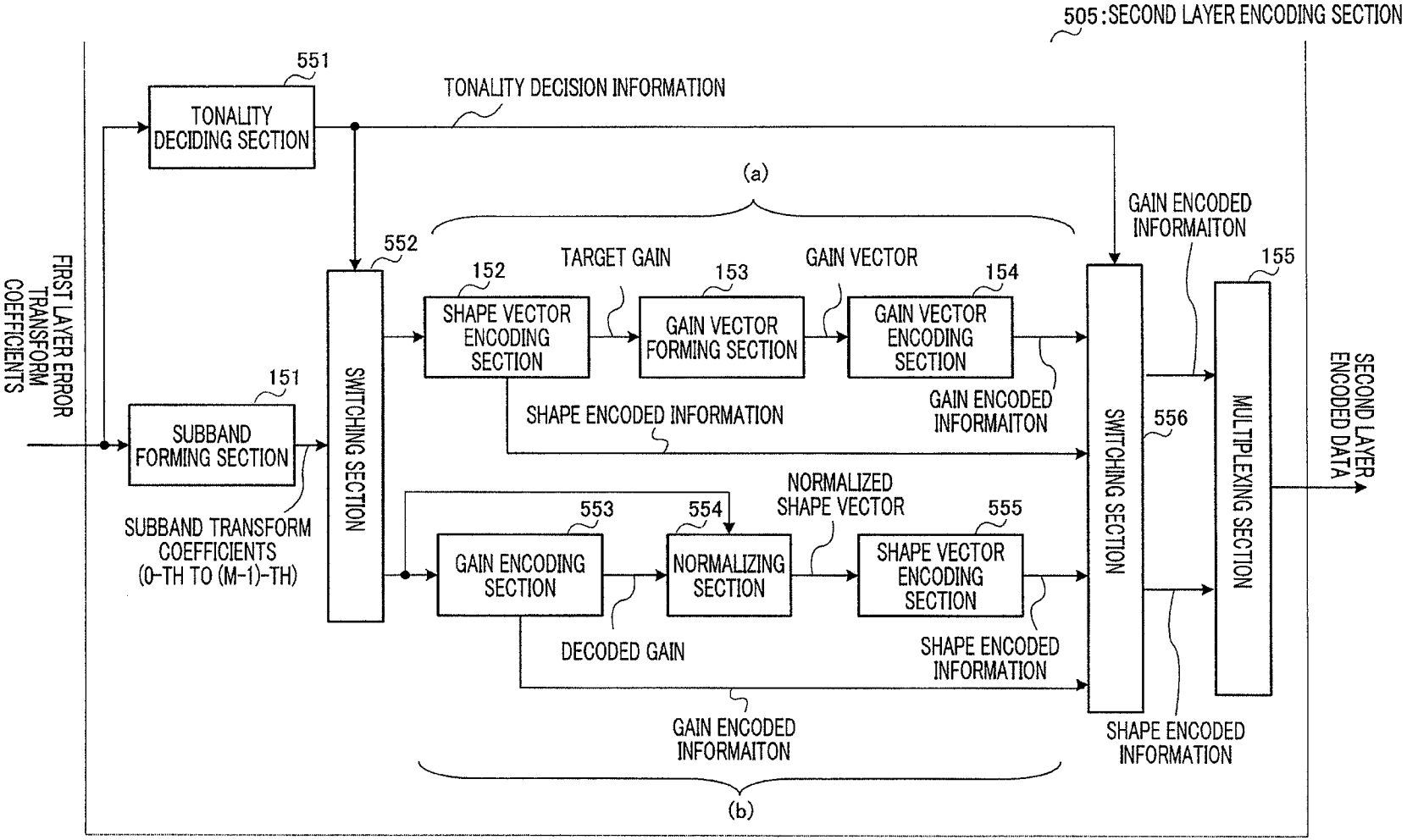
FIG. 22 is a block diagram showing the configuration inside the second layer encoding section according to Embodiment 4 of the present invention.

FIG. 22 is a block diagram showing the configuration inside second layer encoding section 505. Further, second layer encoding section 505 employs the same basic configuration as second layer encoding section 105 shown in FIG. 1, and the same components will be assigned the same reference numerals and explanation thereof will be omitted.

Second layer encoding section 505 differs from second layer encoding section 105 according to Embodiment 1 in further including tonality deciding section 551, switching section 552, gain encoding section 553, normalizing section 554, shape vector encoding section 555 and switching section 556. Further, in FIG. 22, shape vector encoding section 152, gain vector forming section 153, and gain vector encoding section 154 constitute the encoding sequence (a), and gain encoding section 553, normalizing section 554 and shape vector encoding section 555 constitute the encoding sequence (b).

Tonality deciding section 551 calculates an SFM as an indicator to evaluate tonality of the first layer error transform coefficients received from subtractor 104, outputs "high" as tonality decision information to switching section 552 and switching section 556 when the calculated SFM is smaller than the predetermined threshold and outputs "low" as tonality decision information to switching section 552 and switching section 556 when the calculated SFM is equal to or greater than the predetermined threshold.

Meanwhile, although the present embodiment is explained using the SFM as an indicator to evaluate tonality, the present invention is not limited to this, and decision may be made using another indicator such as the variance of the first layer error transform coefficients. Moreover, decision may be performed using another signal such as an input signal to decide tonality. For example, a pitch analysis result of an input signal or a result of encoding the input signal in a lower layer (i.e. the first layer encoding section with the present embodiment) may be used.

Switching section 552 sequentially outputs M subband transform coefficients received from subband forming section 151, to shape vector encoding section 152 when the tonality decision information received from tonality deciding section 551 shows "high," and sequentially outputs M subband transform coefficients received from subband forming section 151, to gain encoding section 553 and normalizing section 554 when the tonality decision information received from tonality deciding section 551 shows "low."

Gain encoding section 553 calculates the average energy of M subband transform coefficients received from switching section 552, quantizes the calculated average energy and outputs the quantized index as gain encoded information, to switching section 556. Further, gain encoding section 553 performs gain decoding processing using the gain encoded information, and outputs the resulting decoded gain to normalizing section 554.

Normalizing section 554 normalizes the M subband transform coefficients received from switching section 552 using the decoded gain received from gain encoding section 553, and outputs the resulting normalized shape vector to shape vector encoding section 555.

Shape vector encoding section 555 performs encoding processing with respect to the normalized shape vector received from normalizing section 554, and outputs the resulting shape encoded information to switching section 556.

Switching section 556 outputs shape encoded information and gain encoded information received from shape vector encoding section 152 and gain vector encoding section 154, respectively, when the tonality decision information received from tonality deciding section 551 shows "high," and outputs shape encoded information and gain encoded information received from gain encoding section 553 and shape vector encoding section 555, respectively, when the tonality decision information received from tonality deciding section 551 shows "low."

As described above, the speech encoding apparatus according to the present embodiment performs shape vector encoding temporally prior to gain encoding using the sequence (a) in case where the tonality of the first layer error transform coefficients is "high," and performs gain encoding temporally prior to shape vector encoding using the sequence (b) in case where the tonality of the first layer error transform coefficients is "low."

In this way, the present embodiment adaptively changes the order of gain encoding and shape vector encoding according to tonality of the first layer error transform coefficients and, consequently, can suppress both gain encoding distortion and shape vector encoding distortion according to an input signal which is the target to be encoded, so that it is possible to further improve sound quality of decoded speech.

(Embodiment 5)

Figure 23:
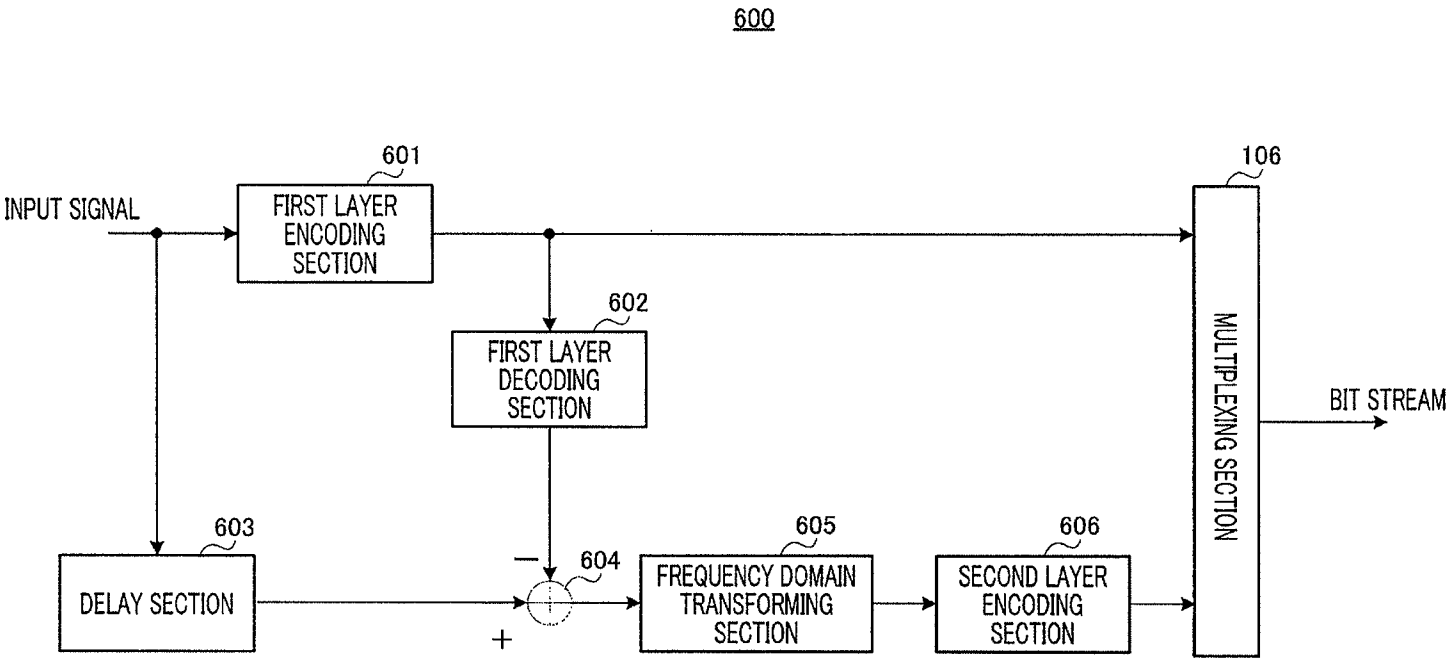
FIG. 23 is a block diagram showing the main configuration of the speech encoding apparatus according to Embodiment 5 of the present invention.

FIG. 23 is a block diagram showing the main configuration of speech encoding apparatus 600 according to Embodiment 5 of the present invention.

In FIG. 23, speech encoding apparatus 600 has first layer encoding section 601, first layer decoding section 602, delay section 603, subtractor 604, frequency domain transforming section 605, second layer encoding section 606 and multiplexing section 106. Among these components, multiplexing section 106 is the same as multiplexing section 106 shown in FIG. 1, and, therefore, detailed explanation thereof will be omitted. Further, second layer encoding section 606 differs from second layer encoding section 305 shown in FIG. 12 in part of processing, and different reference numerals will be assigned to show this difference.

First layer encoding section 601 encodes an input signal, and outputs the generated first layer encoded data to first layer decoding section 602 and multiplexing section 106. First layer encoding section 601 will be described in detail later.

First layer decoding section 602 performs decoding processing using the first layer encoded data received from first layer encoding section 601, and outputs the generated first layer decoded signal to subtractor 604. First layer decoding section 602 will be described in detail later.

Delay section 603 applies a predetermined delay to the input signal and outputs the input signal to subtractor 604. The duration of delay is equal to the duration of delay produced in processings in first layer encoding section 601 and first layer decoding section 602.

Subtractor 604 calculates the difference between the delayed input signal received from delay section 603 and the first layer decoded signal received from first layer decoding section 602, and outputs the resulting error signal to frequency domain transforming section 605.

Frequency domain transforming section 605 transforms the error signal received from subtractor 604, into a frequency domain signal, and outputs the resulting error transform coefficients to second layer encoding section 606.

Figure 24:
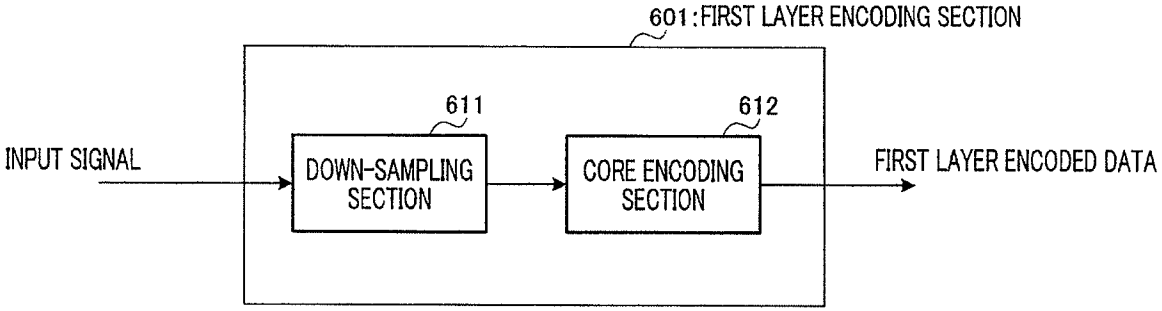
FIG. 24 is a block diagram showing the main configuration inside the first layer encoding section according to Embodiment 5 of the present invention.

FIG. 24 is a block diagram showing the main configuration inside first layer encoding section 601.

In FIG. 24, first layer encoding section 601 has down-sampling section 611 and core encoding section 612.

Down-sampling section 611 down-samples the time domain input signal to convert the sampling rate of the time domain signal into a desired sampling rate, and outputs the down-sampled time domain signal to core encoding section 612.

Core encoding section 612 performs encoding processing with respect to the input signal converted into the desired sampling rate, and outputs the generated first layer encoded data to first layer decoding section 602 and multiplexing section 106.

Figure 25:
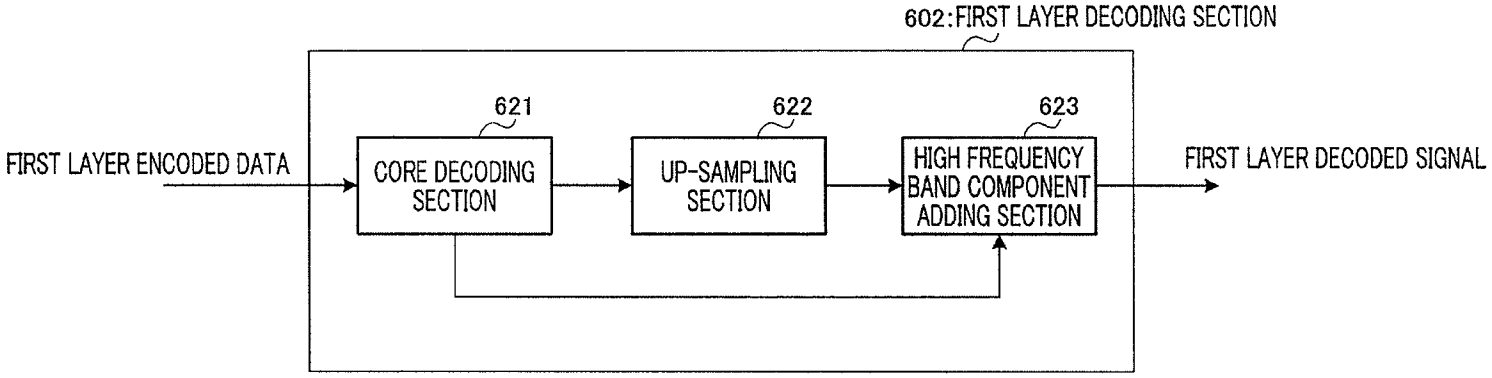
FIG. 25 is a block diagram showing the main configuration inside the first layer decoding section according to Embodiment 5 of the present invention.

FIG. 25 is a block diagram showing the main configuration: inside first layer decoding section 602.

In FIG. 25, first layer decoding section 602 has core decoding section 621, up-sampling section 622 and high frequency band component adding section 623, and substitutes an approximate signal for a high frequency band. This is based on a technique of realizing improvement in sound quality of decoded speech entirely by representing a high frequency band of low perceptual importance with an approximate signal and instead increasing the number of bits to be allocated in a perceptually important low frequency band (or middle-low frequency band) to improve the fidelity of this band with respect to the original signal.

Core decoding section 621 performs decoding processing using the first layer encoded data received from first layer encoding section 601, and outputs the resulting core decoded signal to up-sampling section 622. Further, core decoding section 621 outputs the decoded LPC coefficients found in decoding processing, to high frequency band component adding section 623.

Up-sampling section 622 up-samples the decoded signal received from core decoding section 621 to convert the sampling rate of the decoded signal into the same sampling rate as the input signal, and outputs the up-sampled core decoded signal to high frequency band component adding section 623.

Using an approximate signal, high frequency band component adding section 623 compensates a high frequency band component which has become missing due to down-sampling processing in down-sampling section 611. As a method of generating an approximate signal, a method of forming a synthesis filter with the decoded LPC coefficients found in decoding processing in core decoding section 621 and sequentially filtering a noise signal for which energy is adjusted, by means of the synthesis filter and bandpass filter, is known. The high frequency band component acquired in this method contributes to enhancement of perceptual feeling of a band but has a completely different waveform from the high frequency band component of the original signal, and, therefore, energy in the high frequency band of the error signal acquired in the subtractor increases.

When the first layer encoding processing includes such characteristics, energy in a high frequency band of the error signal increases, so that a low frequency band that essentially has a high perceptual sensitivity is not likely to be selected. Consequently, second layer encoding section 606 according to the present embodiment selects a range from candidates arranged at lower frequencies than a predetermined frequency (i.e. reference frequency), so that it is possible to prevent the above-described problem caused by an increase in energy of the error signal in a high frequency band. That is, second layer encoding section 606 performs selecting processing shown in FIG. 15.

Figure 26:
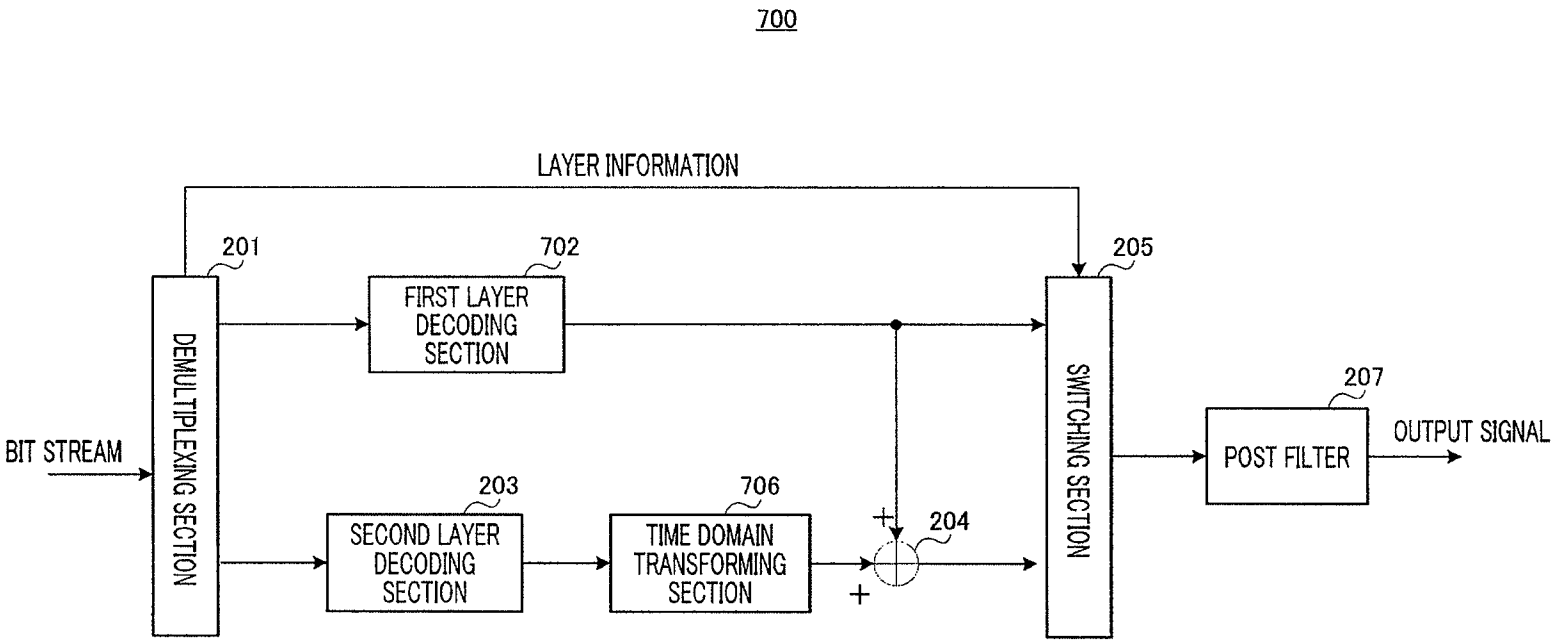
FIG. 26 is a block diagram showing the main configuration of the speech decoding apparatus according to Embodiment 5 of the present invention.

FIG. 26 is a block diagram showing the main configuration of speech decoding apparatus 700 according to Embodiment 5 of the present invention. Meanwhile, speech decoding apparatus 700 has the same basic configuration as speech decoding apparatus 200 shown in FIG. 8, and the same components will be assigned the same reference numerals and explanation thereof will be omitted.

First layer decoding section 702 of speech decoding apparatus 700 differs from first layer decoding section 202 of speech decoding apparatus 200 in part of processing, and, therefore, different reference numerals will be assigned. Further, the configuration and operation of first layer decoding section 702 are the same as in first layer decoding section 602 of speech encoding apparatus 600, and, therefore, detailed explanation thereof will be omitted.

Time domain transforming section 706 of speech decoding apparatus 700 differs from time domain transforming section 206 of speech decoding apparatus 200 only in arrangement positions but performs the same processing, and, therefore, different reference numerals will be assigned and detailed explanation thereof will be omitted.

In this way, the present embodiment substitutes an approximate signal such as noise for a high frequency band in encoding processing in the first layer, instead increasing the number of bits to be allocated in a perceptually important low frequency band (or middle-low frequency band) to improve fidelity with respect to the original signal of this band, further preventing a problem due to an increase in the energy of the error signal in a high frequency band using the lower range than a predetermined frequency as the target to be encoded in second layer encoding processing and performing shape vector encoding temporally prior to gain encoding, so that it is possible to more accurately encode the spectral shapes of signals of strong tonality such as vowels, further reduce gain vector encoding distortion without increasing the bit rate and, consequently, further improve the sound quality of decoded speech.

Further, although a case has been explained as an example where subtractor 604 finds the difference between time domain signals, the present invention is not limited to this and subtractor 604 may find the difference between frequency domain transform coefficients. In such a case, input transform coefficients are found by arranging frequency domain transforming section 605 between delay section 603 and subtractor 604, and the first layer decoded transform coefficients are found by arranging another frequency domain transforming section between first layer decoding section 602 and subtractor 604. Then, subtractor 604 finds the difference between the input transform coefficients and the first layer decoded transform coefficients, and gives this error transform coefficients directly to second layer encoding section 606. This configuration enables adaptive subtracting processing of finding difference in a given band and not finding difference in other bands, so that it is possible to further improve the sound quality of decoded speech.

Further, although a configuration has been explained with the present embodiment as an example where information related to a high frequency band is not transmitted to the speech decoding apparatus, the present invention is not limited to this, and a configuration may be possible where a signal of a high frequency band is encoded at a low bit rate compared to a low frequency band and is transmitted to a speech decoding apparatus.

(Embodiment 6)

Figure 27:
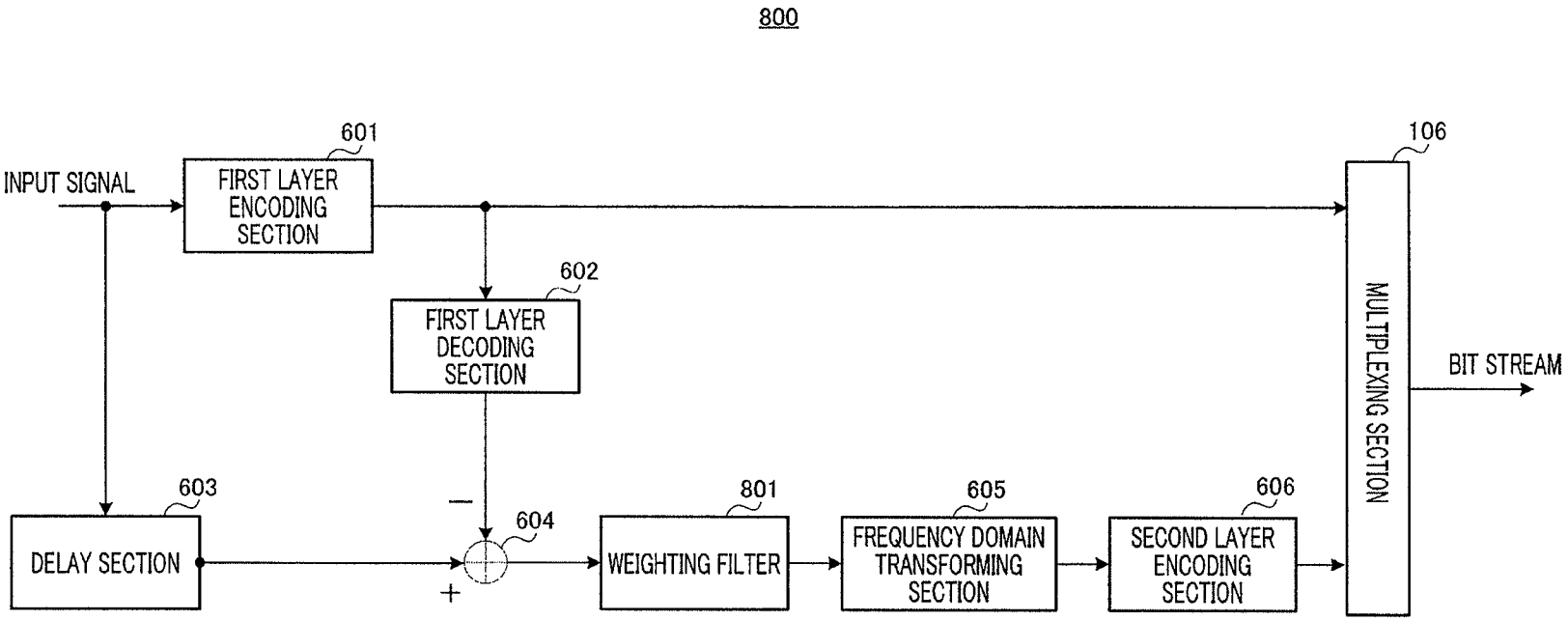
FIG. 27 is a block diagram showing the main configuration of the speech encoding apparatus according to Embodiment 6 of the present invention.

FIG. 27 is a block diagram showing the main configuration of speech encoding apparatus 800 according to Embodiment 6 of the present invention. Further, speech encoding apparatus 800 employs the same basic configuration as speech encoding apparatus 600 shown in FIG. 23, and the same components will be assigned the same reference numerals and explanation thereof will be omitted.

Speech encoding apparatus 800 differs from speech encoding apparatus 600 in further including weighting filter 801.

Weighting filter 801 performs perceptual weighting by filtering an error signal, and outputs the error signal after weighting, to frequency domain transforming section 605. Weighting filter 801 smoothes (makes white) the spectrum of an input signal or changes it to spectral characteristics to the smoothed spectrum. For example, the weighting filter transfer function w(z) is represented by following equation 12 using the decoded LPC coefficients acquired in first layer decoding section 602.

(Equation 12)

$$W(z) = 1 - \sum_{i=1}^{NP} \alpha(i) \cdot \gamma^i \cdot z^{-i} \quad [12]$$

In equation 12, α(i) is the LPC coefficients, NP is the order of the LPC coefficients, and γ is a parameter for controlling the degree of smoothing (making white) the spectrum and assumes values in the range of 0≤γ≤1. When γ is greater, the degree of smoothing becomes greater, and 0.92, for example, is used for γ.

Figure 28:
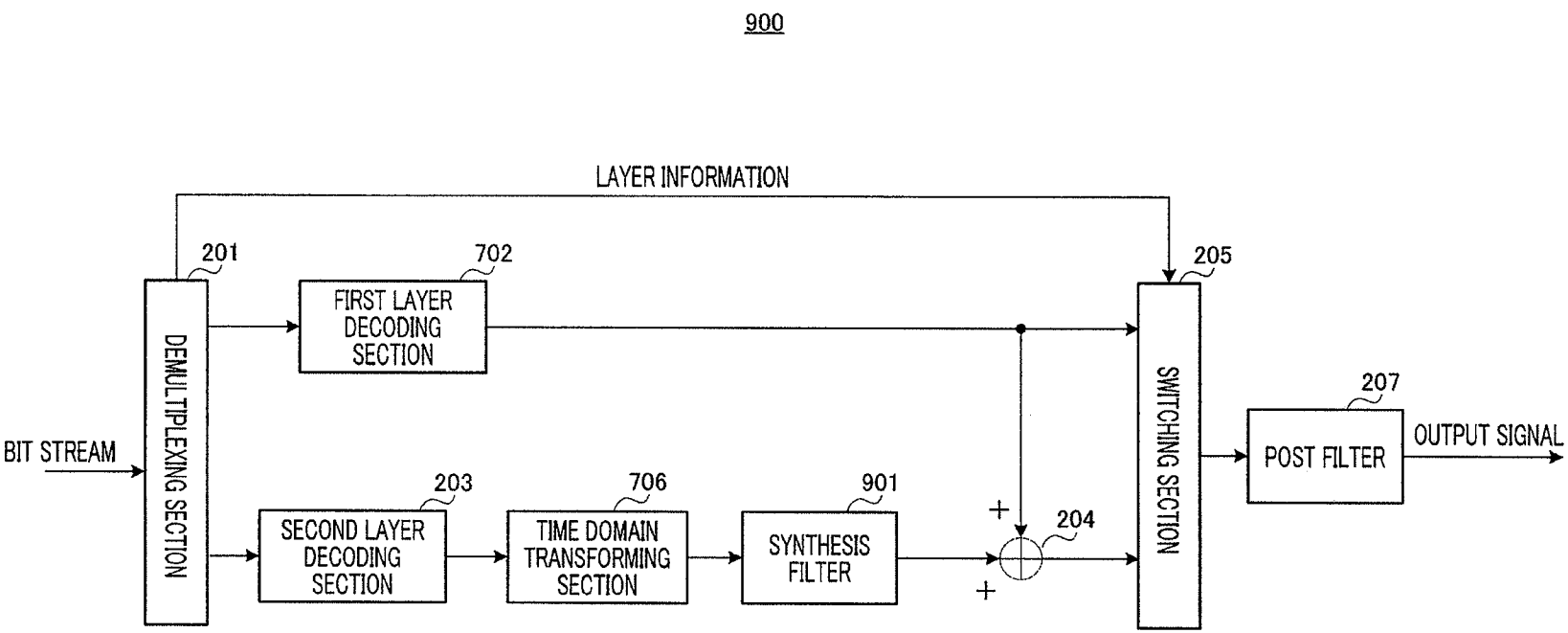
FIG. 28 is a block diagram showing the main configuration of the speech decoding apparatus according to Embodiment 6 of the present invention.

FIG. 28 is a block diagram showing the main configuration of speech decoding apparatus 900 according to Embodiment 6 of the present invention. Further, speech decoding apparatus 900 has the same basic configuration as speech decoding apparatus 700 shown in FIG. 26, and the same components will be assigned the same reference numerals and explanation thereof will be omitted.

Speech decoding apparatus 900 differs from speech decoding apparatus 700 in further including synthesis filter 901.

Synthesis filter 901 is formed with a filter having opposite spectral characteristics to weighting filter 801 of speech encoding apparatus 800, and performs filtering processing with respect to a signal received from time domain transforming section 706 and outputs the result: The transfer function B(z) of synthesis filter 901 is represented using following equation 13.

(Equation 13)

$$B(z) = 1 / W(z) = \frac{1}{1 - \sum_{i=1}^{NP} \alpha(i) \cdot \gamma^i \cdot z^{-i}} \quad [13]$$

In equation 13, α(i) is the LPC coefficients, NP is the order of the LPC coefficients, and is a parameter for controlling the degree of smoothing (making white) the spectrum and assumes values in the range of 0≤γ≤1. When γ is greater, the degree of smoothing becomes greater, and 0.92, for example, is used for γ.

As described above, weighting filter 801 of speech encoding apparatus 800 is formed with a filter having opposite spectral characteristic to the spectral envelope of an input signal, and synthesis filter 901 of speech decoding apparatus 900 is formed with a filter having opposite characteristics to the weighting filter. Consequently, the synthesis filter has the similar characteristics as the spectral envelope of the input signal. Generally, greater energy appears in a low frequency band than in a high frequency band in the spectral envelope of a speech signal, so that, even when the low frequency band and the high frequency band have equal coding distortion of a signal before this signal passes the synthesis filter, coding distortion becomes greater in the low frequency band after this signal passes the synthesis filter. Although, ideally, weighting filter 801 of speech encoding apparatus 800 and synthesis filter 901 of speech decoding apparatus 900 are introduced such that coding distortion is not heard thanks to the perceptual masking effect, when coding distortion cannot be reduced due to the low bit rate, the perceptual masking effect does not function much and coding distortion is likely to be perceived. In such a case, synthesis filter 901 of speech decoding apparatus 900 increases energy in a low frequency band including coding distortion and, therefore, quality deterioration is likely to appearly distinctly. With the present embodiment, as described in Embodiment 5, second layer encoding section 606 selects a range, which is the target to be encoded, from candidates arranged at lower frequencies than a predetermined frequency (i.e. reference frequency), so that it is possible to alleviate the above-described problem of emphasizing coding distortion in a low frequency band and improve the sound quality of decoded speech.

In this way, the present embodiment provides a weighting filter in the speech encoding apparatus, realizes quality improvement by providing the synthesis filter in the speech decoding apparatus and utilizing a perceptual masking effect and uses the lower range than a predetermined frequency as the target to be encoded in second layer encoding processing to alleviate a problem of increasing energy in a low frequency band including coding distortion and to perform shape vector encoding temporally prior to gain coding, so that it is possible to more accurately encode the spectral shapes of signals of strong tonality such as vowels, reduce gain vector encoding distortion without increasing the bit rate and, consequently, further improve the sound quality of decoded speech.

(Embodiment 7)

Selection of the range which is the target to be encoded in each enhancement layer will be explained with Embodiment 7 of the present invention in case where the speech encoding apparatus and speech decoding apparatus are configured to include three or more layers formed with one base layer and a plurality of enhancement layers.

Figure 29:
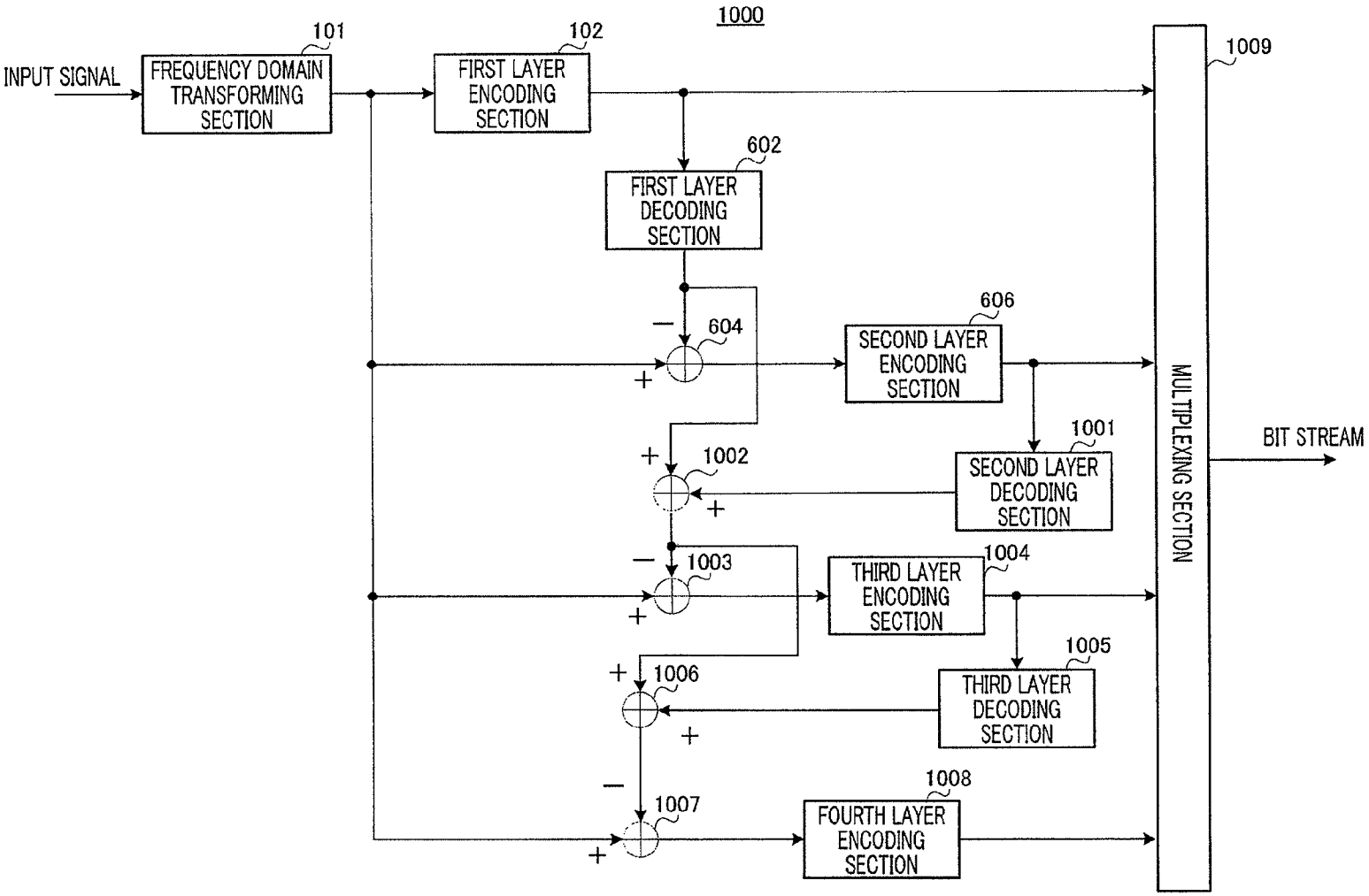
FIG. 29 is a block diagram showing the main configuration of the speech encoding apparatus according to Embodiment 7 of the present invention.

FIG. 29 is a block diagram showing the main configuration of speech encoding apparatus 1000 according to Embodiment 7 of the present invention.

Speech encoding apparatus 1000 has frequency domain transforming section 101, first layer encoding section 102, first layer decoding section 602, subtractor 604, second layer encoding section 606, second layer decoding section 1001, adder 1002, subtractor 1003, third layer encoding section 1004, third layer decoding section 1005, adder 1006, subtractor 1007, fourth layer encoding section 1008 and multiplexing section 1009, and is formed with four layers. Among these components, the configurations and operations of frequency domain transforming section 101 and first layer encoding section 102 are as shown in FIG. 1, the configurations and operations of first layer decoding section 602, subtractor 604 and second layer encoding section 606 are as shown in FIG. 23, and the configurations and operations of blocks having numbers 1001 to 1009 are similar to the configurations and operations of the blocks 101, 102, 602, 604 and 606 and can be estimated and, therefore, detailed explanation will be omitted here.

Figures 30A, 30B, 30C:
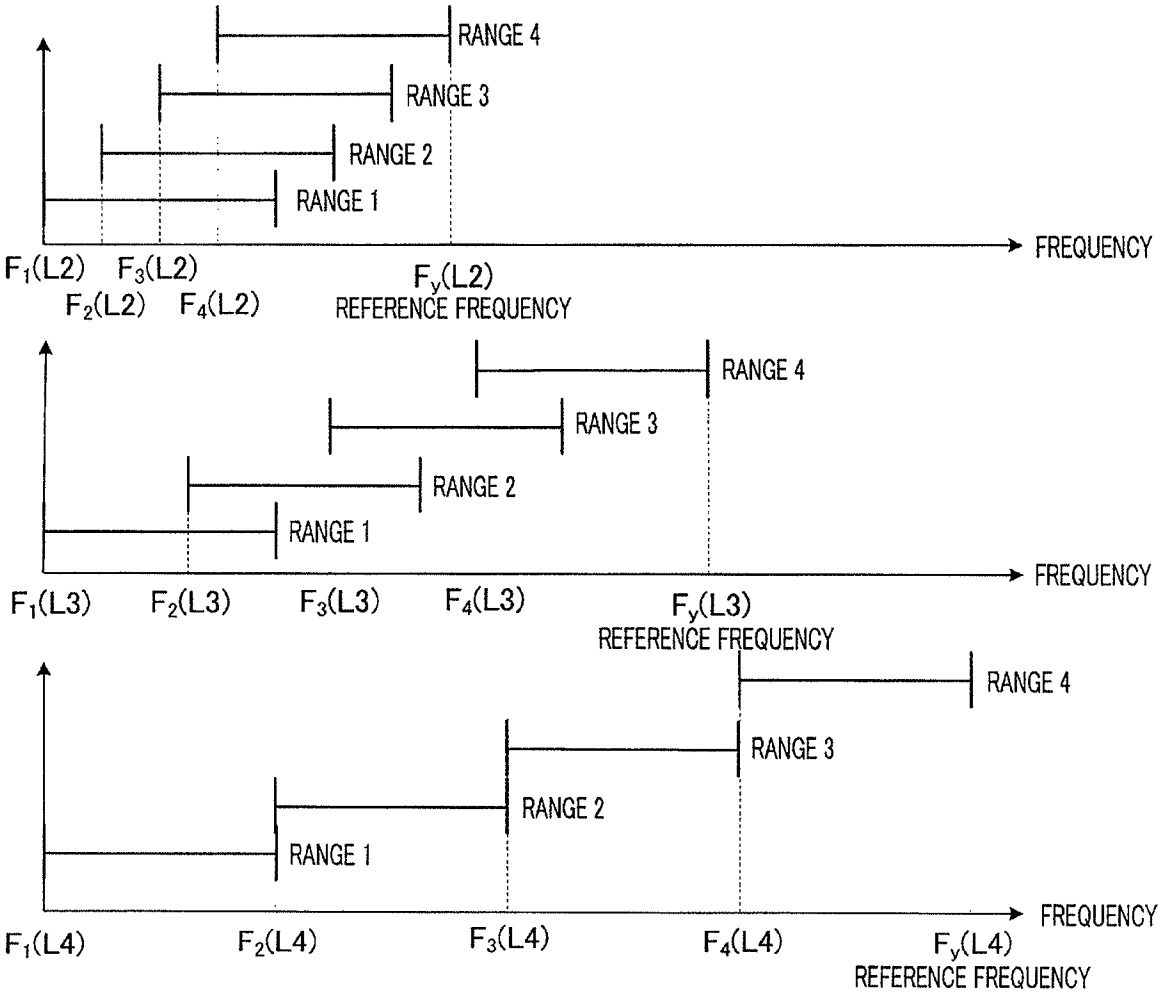
FIGS. 30A-30C illustrate processing of selecting the range which is the target to be encoded in encoding processing in the speech encoding apparatus according to Embodiment 7 of the present invention.

FIG. 30 illustrates processing of selecting the range which is the target to be encoded in encoding processing of speech encoding apparatus 1000. FIG. 30A to FIG. 30C illustrate processing of selecting ranges in second layer encoding in second layer encoding section 606, third layer encoding in third layer encoding section 1004 and fourth layer encoding in fourth layer encoding section 1008.

As shown in FIG. 30A, selection range candidates are arranged in lower bands than the second layer reference frequency Fy(L2) in the second layer encoding, selection range candidates are arranged in lower bands than the third layer reference frequency Fy(L3) in the third layer encoding and selection range candidates are arranged in lower bands than the fourth layer reference frequency Fy(L4) in the fourth layer encoding. Further, the relationship of Fy(L2)<Fy(L3)<Fy(L4) holds between the reference frequencies of the enhancement layers. The number of selection range candidates in each enhancement layer is the same, and a case where the number of range candidates is four will be described as an example. That is, in a lower layer of a lower bit rate (for example, the second layer), the range which is the target to be encoded is selected from low frequency bands of perceptually higher sensitivities, and, in a higher layer of a higher bit rate (for example, the fourth layer), the range which is the target to be encoded is selected from wider bands including up to a high frequency band. By employing such a configuration, a lower layer emphasizes a low frequency band and a higher layer covers a wider band, so that it is possible to realize quality sound of speech signals.

Figure 31:
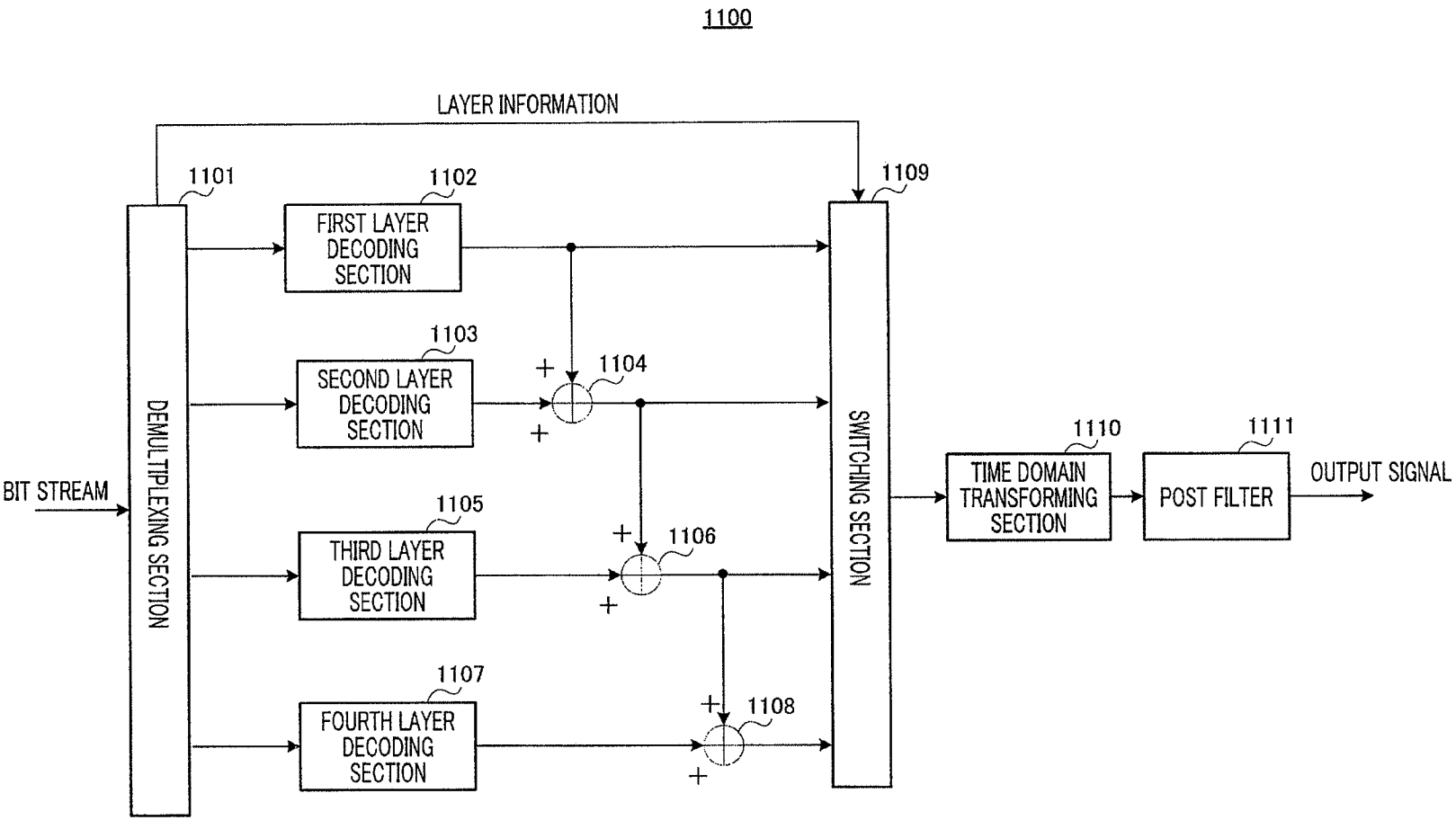
FIG. 31 is a block diagram showing the main configuration of the speech decoding apparatus according to Embodiment 7 of the present invention.

FIG. 31 is a block diagram showing the main configuration of speech decoding apparatus 1110 according to the present embodiment.

In FIG. 31, speech decoding apparatus 1100 has demultiplexing section 1101, first layer decoding section 1102, second layer decoding section 1103, adding section 1104, third layer decoding section 1105, adding section 1106, fourth layer decoding section 1107, adding section 1108, switching section 1109, time domain transforming section 1110 and post filter 1111, and is formed with four layers. Meanwhile, the configurations and operations of these blocks are similar to the configurations and operations of blocks in speech decoding apparatus 200 shown in FIG. 8 and can be estimated, and, therefore, detailed explanation thereof will be omitted.

In this way, according to the present embodiment, the scalable speech encoding apparatus selects the range which is the target to be encoded, from low frequency bands of higher perceptual sensitivities in a lower layer of a lower bit rate and selects the range which is the target to be encoded, from wider bands including up to a high frequency band in a higher layer of a higher bit rate, to emphasize the low frequency band in the lower layer and cover wider bands in the higher layer and to perform shape vector encoding temporally prior to gain encoding, so that it is possible to more accurately encode the spectral shapes of signals of strong tonality such as vowels, further reduce gain vector coding distortion without increasing the bit rate and further improve the sound quality of decoded speech.

Figure 32A:
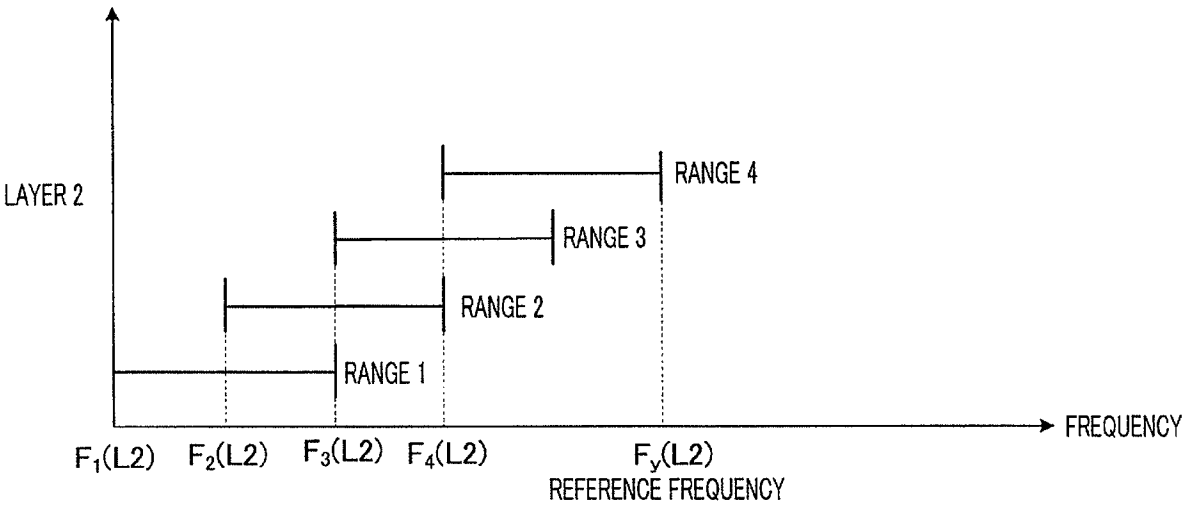
FIGS. 32A and 32B illustrate a case where the target to be encoded is selected from range candidates arranged at equal intervals, in encoding processing in the speech encoding apparatus according to Embodiment 7 of the present invention.
Figure 32B:
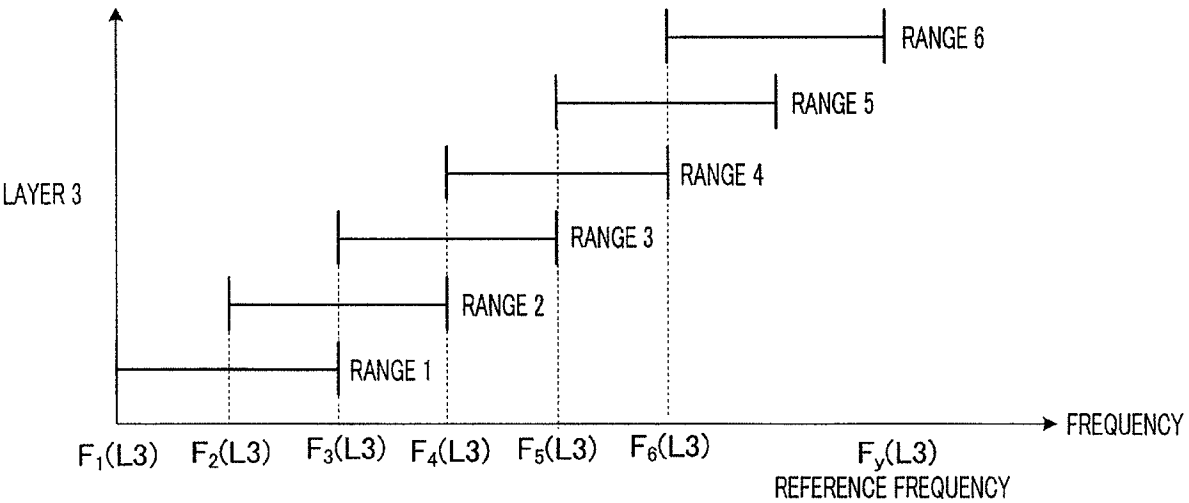
Figure 33:
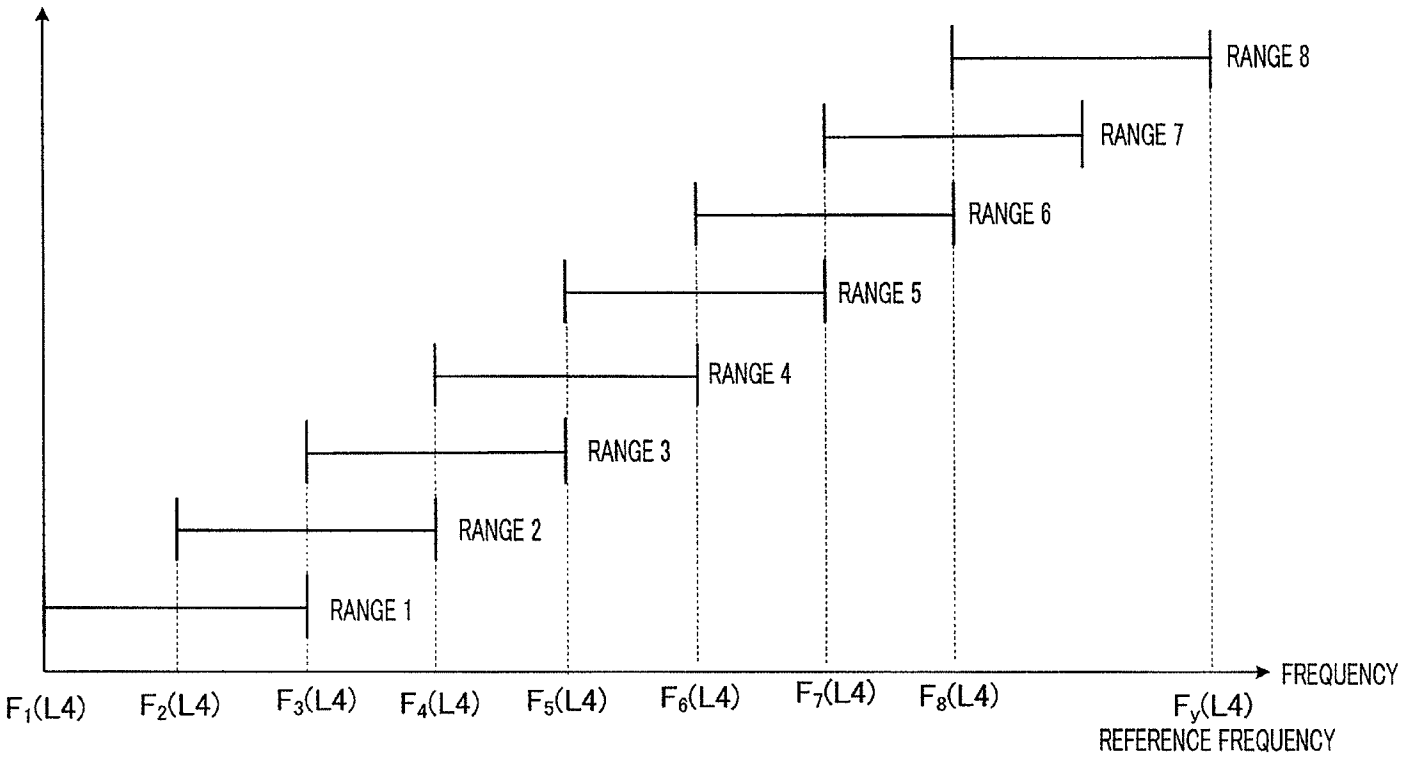
FIG. 33 illustrates a case where the target to be encoded is selected from range candidates arranged at equal intervals, in encoding processing in the speech encoding apparatus according to Embodiment 7 of the present invention.

Further, although a case has been explained with the present embodiment as an example where the target to be encoded is selected from range selection candidates shown in FIG. 30 in encoding processing in each enhancement layer, the present invention is not limited to this, and the target to be encoded may be selected from range candidates arranged at equal intervals as shown in FIG. 32 and FIG. 33.

FIG. 32A, FIG. 32B and FIG. 33 illustrate range selecting processing in second layer encoding, third layer encoding and fourth layer encoding. As shown in FIG. 32 and FIG. 33, the number of selection range candidates varies between enhancement layers, and a case will be illustrated here where the numbers of selection range candidates are four, six and eight. In such a configuration, the range which is the target to be encoded is determined from low frequency bands, in a lower layer, and the number of selection range candidates is smaller compared to a higher layer, so that it is possible to reduce the computational complexity and bit rate.

Further, as a method of selecting the range which is the target to be encoded by each enhancement layer, the range of the current layer may be selected in association with the range selected in the lower layer. For example, there are methods of (1) determining the range of the current layer from the ranges positioned in the vicinity of the range selected in the lower layer, (2) rearranging the range candidates for the current layer in the vicinity of the range selected in the lower layer to determine the range of the current layer from the rearranged range candidates and (3) transmitting range information once every several frames and using the range shown by range information transmitted in the past, in the frame in which range information not transmitted (discontinuous transmission of range information).

Embodiments of the present invention have been explained.

Further, although a scalable configuration of two layers has been explained as an example of the configuration of the speech encoding apparatus and speech decoding apparatus, the present invention is not limited to this, and the scalable configuration of three or more layers may be possible. Furthermore, the present invention is also applicable to a speech encoding apparatus that does not employs a scalable configuration.

Still further, the above-described embodiments can use the CELP method as the first layer encoding method.

The frequency domain transforming section in the above embodiments is implemented by FFT, DFT (Discrete Fourier Transform), DCT (Discrete Cosine Transform), MDCT (Modified Discrete Cosine Transform), a subband filter and so on.

Although the above-described embodiments assume speech signals as decoded signals, the present invention is not limited to this and, for example, decoded signals may be possible as audio signals.

Also, although cases have been described with the above embodiment as examples where the present invention is configured by hardware, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2007-053502, filed on Mar. 2, 2007, Japanese Patent Application No. 2007-133545, filed on May 18, 2007, Japanese Patent Application No. 2007-185077, filed on Jul. 13, 2007, and Japanese Patent Application No. 2008-045259, filed on Feb. 26, 2008, including the specifications, drawings and abstracts, are incorporated herein by reference in their entirety.

INDUSTRIAL APPLICABILITY

The speech encoding apparatus and speech encoding method according to the present invention are applicable to a wireless communication terminal apparatus, base station apparatus and so on in a mobile communication system.

What is claimed is:

1. An encoding apparatus comprising:

a first layer encoder that encodes an input signal to acquire first layer encoded data;

a first layer decoder that decodes the first layer encoded data to acquire a first layer decoded signal;

a first layer error transform coefficient calculator that transforms a first layer error signal that is a difference between the input signal and the first layer decoded data into a frequency domain to calculate a first layer error transform coefficient; and a second layer encoder that encodes the first layer error transform coefficient to acquire second layer encoded data, wherein the second layer encoder comprises:

a band determiner that determines a band which is a target to be encoded by the second layer encoder, based on tonality or energy of the input signal;

a first shape vector encoder that refers the first layer error transform coefficient included in the band which is determined by the band determiner and has a predetermined first bandwidth, to generate a first shape vector by arranging a predetermined number of pulses in the band, and to generate first shape encoded information from positions of the predetermined number of pulses;

a target gain calculator that calculates a target gain per subband having a predetermined second bandwidth, using the first layer error transform coefficient and the first shape vector included in the band;

a gain vector generator that generates a gain vector using a plurality of the target gains calculated per subband; and a gain vector encoder that encodes the gain vector to acquire first gain encoded information.

2. The encoding apparatus according to claim 1, further comprising:

a tonality determiner that determines a strength of tonality of the input signal;

a gain encoder that encodes a gain of each of the plurality of subbands in a part of the band of the first layer error transform coefficient, to acquire second gain encoded information;

a normalizer that normalizes each of the first layer error transform coefficients of the plurality of subbands to acquire a plurality of normalized shape vectors, using a decoded gain that is acquired by decoding the second gain encoded information;

a second shape vector encoder that encodes each of the plurality of normalized shape vectors to acquire second shape encoded information; and a determiner that calculates tonality of the input signal per frame, outputs the first layer error transform coefficient to the first shape vector encoder when the tonality is determined to be greater than a threshold, and outputs the first layer error transform coefficient to the gain encoder when the tonality is determined to be smaller than the threshold.

3. A decoding apparatus comprising:

a receiver that receives first layer encoded data and second layer encoded data, the first layer encoded data being acquired by encoding input data, the second layer encoded data being acquired by decoding the first layer encoded data to acquire a first layer decoded signal, calculating a first layer error transform coefficient by transforming a first layer error signal into a frequency domain, where the first layer error signal is a difference between the input signal and the first layer decoded signal, and encoding the calculated first layer error transform coefficient;

a first layer decoder that decodes the first layer encoded data to generate a first layer decoded signal;

a second layer decoder that decodes the second layer encoded data to generate a first layer decoded error transform coefficient;

a time domain transformer that transforms the first layer decoded error transform coefficient into a time domain to generate a first decoded error signal; and an adder that adds the first layer decoded signal and the first layer decoded error signal to generate a decoded signal, wherein the second layer encoded data includes first shape encoded information and first gain encoded information, the first shape encoded information is acquired from positions of a plurality of pulses of a first shape vector generated by arranging a pulse at positions of a plurality of transform coefficients with a large amplitude value, for a part of a band of the first layer error transform coefficient; and the first gain encoded information is acquired by dividing the first shape vector into a plurality of subbands, dividing the part of the band of the first layer error transform coefficient into a plurality of subbands, calculating a target gain per subband using the first shape vector and the first layer error transform coefficient, and encoding one gain vector comprising the plurality of target gains.

4. An encoding method comprising:

performing first encoding processing with respect to an input signal to acquire first layer encoded data;

decoding the first layer encoded data to acquire a first layer decoded signal;

transforming a first layer error signal that is a difference between the input signal and the first layer decoded data into a frequency domain to calculate a first layer error transform coefficient; and performing second encoding processing with respect to the first layer error transform coefficient to acquire second layer encoded data, wherein the second encoding processing comprises:

determining a band which is a target to be encoded by the second encoding processing, based on tonality or energy of the input signal;

referring the first layer error transform coefficient included in the determined band which has a predetermined first bandwidth, to generate a first shape vector by arranging a predetermined number of pulses in the band, and to generate first shape encoded information from positions of the predetermined number of pulses;

calculating a target gain per subband having a predetermined second bandwidth, using the first layer error transform coefficient and the first shape vector included in the band;

generating a gain vector using a plurality of the target gains calculated per subband; and encoding the gain vector to acquire first gain encoded information.

5. A decoding method comprising:

receiving first layer encoded data and second layer encoded data, the first layer encoded data being acquired by encoding input data, the second layer encoded data being acquired by decoding the first layer encoded data to acquire a first layer decoded signal, calculating a first layer error transform coefficient by transforming a first layer error signal into a frequency domain, where the first layer error signal is a difference between the input signal and the first layer decoded signal, and encoding the calculated first layer error transform coefficient;

decoding the first layer encoded data to generate a first layer decoded signal;

decoding the second layer encoded data to generate a first layer decoded error transform coefficient;

transforming the first layer decoded error transform coefficient into a time domain to generate a first decoded error signal; and adding the first layer decoded signal and the first layer decoded error signal to generate a decoded signal, wherein the second layer encoded data includes first shape encoded information and first gain encoded information, the first shape encoded information is acquired from positions of a plurality of pulses of a first shape vector generated by arranging a pulse at positions of a plurality of transform coefficients with a large amplitude value, for a part of a band of the first layer error transform coefficient; and the first gain encoded information is acquired by dividing the first shape vector into a plurality of subbands, dividing the part of the band of the first layer error transform coefficient into a plurality of subbands, calculating a target gain per subband using the first shape vector and the first layer error transform coefficient, and encoding one gain vector comprising the plurality of target gains.

* * * * *